US012687020B2

(12) United States Patent
Nowak et al.

(10) Patent No.: US 12,687,020 B2
(45) Date of Patent: Jul. 21, 2026

(54) CONCRETE SHAPING INSERT, METHOD FOR PRODUCING A CONCRETE SHAPING INSERT, AND METHOD FOR PRODUCING A CONCRETE COMPONENT

(71) Applicant: Unidome Deutschland GmbH, Eltville am Rhein (DE)

(72) Inventors: Felix Nowak, Bad Schwalbach (DE); Karsten Pfeffer, Wiesbaden (DE)

(73) Assignee: UNIDOME DEUTSCHLAND GMBH, Eltville am Rhein (DE)

( * ) Notice: Subject to any disclaimer, the term of this patent is extended or adjusted under 35 U.S.C. 154(b) by 597 days.

(21) Appl. No.: 17/774,842

(22) PCT Filed: Nov. 3, 2020

(86) PCT No.: PCT/EP2020/080838

§ 371 (c)(1),
(2) Date: Oct. 31, 2022

(87) PCT Pub. No.: WO2021/089560

PCT Pub. Date: May 14, 2021

(65) Prior Publication Data

US 2023/0056558 A1 Feb. 23, 2023

(30) Foreign Application Priority Data

Nov. 5, 2019 (LU) ..... 101468

(51) Int. Cl.
*E04C 5/20* (2006.01)

(52) U.S. Cl.
CPC ..... *E04C 5/203* (2013.01)

(58) Field of Classification Search
CPC . E04B 5/328; E04B 5/32; E04B 5/326; E04C 5/06; E04C 5/203
See application file for complete search history.

(56) References Cited

U.S. PATENT DOCUMENTS

2004/0050945 A1* 3/2004 Bernhardt ..... F24D 3/146 165/56
2012/0200004 A1* 8/2012 Levinton ..... E04B 5/328 264/273
2012/0311959 A1* 12/2012 Miedzik ..... E04B 5/328 52/745.13

FOREIGN PATENT DOCUMENTS

DE 202006002540 U1 8/2006
EP 1568827 A1 8/2005
EP 2075387 A1 7/2009
EP 2589719 A1 5/2013
(Continued)

OTHER PUBLICATIONS

JP2004244938A English Translation, 2004 (Year: 2004).*
(Continued)

*Primary Examiner* — Xiao S Zhao
*Assistant Examiner* — Victoria Bartlett
(74) *Attorney, Agent, or Firm* — Hodgson Russ LLP

(57) ABSTRACT

The invention relates to a concrete shaping insert, which is formed to be arranged in a formwork mold before a concreting process, comprising a first and second fixing element, between which at least one displacement body is arranged. The concrete shaping insert is characterized in that, the displacement body has an interstitial tube and that the first and second fixing element are connected to one another with at least one connecting component, which proceed through the interstitial tube.

27 Claims, 29 Drawing Sheets

(56) References Cited

FOREIGN PATENT DOCUMENTS

| | | | | | |
|---|---|---|---|---|---|
| EP | 3045605 | A1 | | 7/2016 | |
| ES | 2288441 | A1 | | 1/2008 | |
| JP | 2004244938 | A | | 9/2004 | |
| JP | 2006077520 | A | * | 3/2006 | ..... E04B 5/326 |
| KR | 20090050259 | A | | 5/2009 | |
| KR | 100958407 | B1 | * | 5/2010 | ..... E04B 5/328 |
| KR | 20100083035 | A | | 7/2010 | |
| KR | 2011058125 | A | * | 6/2011 | ..... E04B 5/326 |
| WO | 02092935 | A1 | | 11/2002 | |
| WO | 2017212317 | A1 | | 12/2017 | |

OTHER PUBLICATIONS

English Translation of KR100958407B1. (Year: 2010).*
WIPO, International Search Report for PCT/EP2020/080838, Feb. 4, 2021.
Göhlmann, Joachim, Special aspects in the planning and Construction of hollow core slabs, grbv Symposium on Building Construction and Industrial Engineering, Sep. 19, 2019, pp. 1-29, 58 pages, URL:https://www.grbv.de/fileadmin/user_upload/Downloads/1_SHI_2019_Hohlkoerperdecken.pdf.

* cited by examiner

CONCRETE SHAPING INSERT, METHOD FOR PRODUCING A CONCRETE SHAPING INSERT, AND METHOD FOR PRODUCING A CONCRETE COMPONENT

BACKGROUND

The invention relates to a concrete shaping insert, which is formed to be arranged in a formwork mold before a concreting process, comprising a first and second fixing element, between which at least one displacement body is arranged.

The invention also relates to a method of manufacturing a concrete shaping insert.

When producing concrete ceilings, in addition to reinforcement, displacement bodies are often arranged in the space surrounded by formwork mold. This has the advantage that concrete can be saved and lighter concrete ceilings can be produced.

EP 1 568 827 A1 proposed to use displacement bodies, e.g. are formed as plastic balls, to be locked in latticework open on one side, and these modules then to be pressed into a first or second layer of concrete, which can already contain a first reinforcement mat. The semi-finished product produced in this way is then covered with concrete mass during later completion.

DE 20 2006 002 540 U1 discloses a module for the production of concrete parts, in particular semi-finished concrete products or concrete ceilings. The module has a plurality of displacers, preferably hollow plastic balls, plastic balls or plastic half-covers, arranged parallel to one another in a longitudinal direction, the plurality of displacement bodies arranged parallel to one another each being arranged captive in a latticework of bars. The module is intended to be pressed into a concrete layer, to be placed on a lower reinforcement or to be placed on a perforation plate. The module is intended to be pressed into a concrete layer, to be placed on a lower reinforcement or to be placed on a perforation plate. The latticework has a channel-like shape with a narrow channel base and a wide channel opening and can be stacked in a space-saving manner when the displacement bodies are not inserted.

EP 2 075 387 A1 discloses a module for the production of concrete parts, in particular semi-finished concrete products or relatively thin in-situ concrete ceilings, is known. The module has a plurality of displacer bodies which can be used and are arranged parallel to one another in a longitudinal direction, the plurality of displacement bodies that arranged parallel to one another being in each case captively arranged in a latticework of bars. Each displacement body is formed as an essentially flattened ellipsoid shape to rotation with at least two slightly flattened pole sides.

EP 3 045 605 A1 discloses a module for the production of concrete parts using the in-situ concrete process or in a precast plant is known, which comprises a row of several displacement bodies arranged parallel to one another in a horizontal longitudinal direction, which are held captive in a latticework of at least two individual, longitudinally extending lattices, the lattice surfaces of which are aligned transversely to the horizontal, wherein each of the grids has at least a first and a second longitudinal rod, which run parallel spaced apart in the longitudinal direction, and a plurality of spaced apart and transversely aligned transverse rods, which are each connected to the longitudinal rods. At least one of the displacement bodies has at least one first and at least one second threading device on its outside for each grille, which are formed and arranged in relation to one another in a manner that the two grids by receiving the first longitudinal bar in the first threading device and receiving the second longitudinal bar in the second threading device are at least positively and captively fixed between the first and second threading device and thereby hold all displacement bodies together.

The previously known concrete shaping inserts have the particular disadvantage that their production is very complex. This is particularly due to very complex two- or three-dimensional lattice works that are adapted to the size and shape of the displacement bodies to be used, which hold the displacement bodies and fixed them in their position relative to the remaining displacement bodies.

It is the object of the present invention to provide a concrete shaping insert, which can be produced simply and stability, in particular partly directly on the construction site, and which can nevertheless be used particularly flexibly.

The object is achieved by a concrete shaping insert, which is characterized in that the displacement body has an interstitial tube and that the first fixing element and the second fixing element are connected to one another with at least one connecting component which proceeds through the interstitial tube.

- a further object of the present invention is providing a method for producing a concrete shaping insert which can be used flexibly and which can be carried out easily.

The object is achieved by a method, which is characterized in that at least one displacement body, which has an interstitial tube, in particular several displacement bodies, are arranged between a first fixing element and a second fixing element and that the first fixing element and the second fixing element are connected by means of a connecting component that proceeds through the interstitial tube.

The invention has a very special feature that a concrete shaping insert can be produced in a simple manner, with standard reinforcement parts that are advantageously available as the first and/or second fixing element, in particular simply and inexpensively, such as a simple reinforcing bar made of structural steel or a simple reinforcement bar Reinforcement mesh made of structural steel, can be used.

In particular, it is of particular advantage that the first fixing element and the second fixing element do not need to have a size or shape specially adapted for the displacement body to be used.

In particular, the present invention advantageously enables the required components to be delivered to the construction site in a space-saving manner and the concrete shaping insert to be produced on site by simply joining the components together, preferably without tools. It is particularly advantageous here, for example, if the first fixing element and the second fixing element are each formed as a simple reinforcing bar. Reinforcing bars of this type are available simply and inexpensively and can be transported in a space-saving manner.

In particular, the invention has the very special advantage that the space surrounding the displacement body, in particular the space surrounding the displacement body horizontally, can remain free and there is thus the possibility of using this space (in particular after a first concreting process in which, for example, only a lower part a concrete ceiling was concreted) to arrange additional reinforcement. According to the invention, however, it is not significantly excluded to use additional connecting elements for connecting the first holder element and the second fixing element. It is also not excluded to use additional displacement body connectors that directly connect adjacent displacement bodies to one another.

The connecting component can advantageously have a first connecting element for mechanical coupling to the first fixing element. Alternatively, or additionally, the connection component can have a second connection element for mechanical coupling to the second fixing element. The connecting elements can in particular be formed identically. However, it is also possible for the connecting elements to differ, in particular with regard to their mode of operation for establishing a connection to the respective holder element.

In a particular embodiment, the connecting component has an elongated web, the first connecting element being arranged at one end of the web and the second connecting element being arranged at the other end of the web.

In an advantageous embodiment, the at least one connecting component is arranged vertically with respect to its direction of longitudinal extent. In particular in such an embodiment, the first fixing element can be arranged below the at least one displacement body, while the second fixing element is arranged above at least one displacement body.

In a particularly advantageous embodiment, the connecting component can be fixed to the first fixing element by means of the first connecting element without tools and in particular without additional connecting means. For this purpose, in particular, the first connecting element can be formed as a latching device. Such an embodiment is based on an independent inventive concept which can also be implemented independently of the presence of an interstitial tube in the displacement bodies and independently of whether the connecting component proceeds through such a connecting tube.

In particular, the connection component can advantageously be formed in a manner that connections to the fixing component that have already been established can be subsequently released again without tools and/or without destruction. Such a design has the particular advantage that it is possible to act very flexibly on the construction site.

For example, the first connecting element can have a hook, in particular an elastic locking hook. The locking hook can advantageously be formed to grip around a section of the first fixing element, in particular a rod-shaped section of the first fixing element.

In an advantageous embodiment, the locking hook has a receptacle for a rod-shaped section of the first fixing element and an insertion gap through which the rod-shaped section of the first fixing element can be inserted into the receptacle. In this case, it can particularly advantageously be provided that the passage width of the insertion gap is smaller than the inside diameter of the receptacle. In this way it is ensured that the connecting component cannot automatically detach itself from the first fixing element after it has snapped into place. This is especially not the case if a second connecting element of the connecting component has not yet been connected to the second fixing element. Instead of that, the first connection element can advantageously be formed in a manner that the connection component, after it has been connected to a rod-shaped section of the first fixing component, can be pivoted around the rod-shaped section without inadvertently detaching from the rod-shaped section. In particular, such a pivoting movement can be used to connect the connecting component to the second fixing element by means of the second connecting element, which is described in detail below.

In a particularly advantageous embodiment, the connecting component can be fixed to the second fixing element by means of the second connecting element without tools and in particular without additional connecting means. In particular for this purpose, the second connecting element can be formed as a latching device. For example, the second connecting element can have a hook, in particular an elastic locking hook.

In a particularly advantageous embodiment, the second connecting element has an indentation for a rod-shaped section of the second fixing element. In particular, it can be provided that the second connecting element has a guide element adjoining the indentation with a guide surface. Such an embodiment is particularly advantageous if the connecting component is formed such that it can be pivoted around a rod-shaped section of the first fixing element after it has been fixed to the first fixing element. In such an embodiment, the first connecting element is first attached to a rod-shaped section of the first fixing element. A displacement body can then be brought into position, the connecting component already pivotably fixed on the first fixing element being guided through the interstitial tube of the displacement body. The connecting component is then pivoted about the rod-shaped section of the first fixing element until it has reached a rod-shaped section of the second fixing element. When the pivoting movement continues, the rod-shaped section of the second fixing element slides along the guide surface, whereby the elastic locking hook of the second connecting element is temporarily bent open until the rod-shaped section reaches the indentation and engages.

The length of the connecting component is preferably matched to the height of the displacement body. This can in particular be implemented in a manner that the displacement body is disposed between the first fixing element and the second fixing element.

In general, the connecting component can advantageously be formed in a manner that it can initially be fastened to the first fixing element by means of the first connecting element, in particular latching, and that it can then be connected to the second fixing element by performing a pivoting movement, in particular latching.

The connecting component can be manufactured as an injection molded part, in particular as a plastic injection molded part. Alternatively, it is also possible, for example, to manufacture the connecting component as a bent part, in particular as a bent sheet metal part or as a bent wire part. It is particularly cost-effective and efficient to manufacture the connecting component in one piece, for example as one-piece injection-molded part. For example, it can advantageously also be provided that the connecting component is produced from a single piece of raw material.

The concrete shaping insert according to the invention preferably has several displacement bodies, in particular several identical displacement bodies. In an advantageous manner, several of the concrete shaping insert according to the invention can then be arranged, in particular next to one another, in a formwork before a concreting process.

In a particularly advantageous embodiment, the at least one displacement body is composed of a first displacement body part and a second displacement body part. Such a form is particularly advantageous from a logistical point of view because individual displacement body parts, especially if they are formed to be stacked one inside the other, can be transported in a particularly space-saving manner.

The interstitial tube can advantageously have a shape deviating from the circular shape in a cross-sectional plane perpendicular to its direction of longitudinal extent. In particular, the interstitial tube can have a polygonal, in particular square, cross section. In particular, the interstitial tube can be formed in this way in a manner that there is sufficient freedom of movement for a fixing movement of the connecting component without unnecessarily forming the interstitial tube.

In a very particular embodiment, the first displacement body part has a first interstitial tube part and the second displacement body part has a second interstitial tube part, the first interstitial tube part and the second interstitial tube part together forming the interstitial tube. Here, it can advantageously be provided that the first interstitial tube part has a first contact surface at the end and that the second interstitial tube part has a second contact surface at the end, the first contact surface and the second contact surface in contact with one another. With such a design it is ensured that the interstitial tube parts can be supported on one another and can thus reliably stabilize the displacement body during a concreting process.

In particular, in order to prevent the interstitial tube parts from shifting with respect to one another in the event of a load, a form-fit connection, in particular a pin connection, can be provided between the first interstitial tube part and the second interstitial tube part.

In a particular embodiment, the first displacement body part has a first connection device and the second displacement body part has a second connection device, the first connection device and the second connection device cooperating and thus connecting the first displacement body part and the second displacement body part to one another.

The first connecting device and the second connecting device are preferably formed to be identical. Such an embodiment is particularly advantageous in order to be able to connect the same displacement body parts (or displacement body parts which differ only in terms of their height) as first and second displacement body parts.

The first connecting device and the second connecting device can advantageously each have at least one latching element. Latching the first and second displacement body parts is particularly advantageous because no additional connecting means are required and because the connecting devices can in particular be formed such that no tools are required to connect the first and second displacement body parts.

In particular, the first displacement body part and the second displacement body part can each be formed in shape-cover, the connecting device being formed such that they can be connected to one another by performing a connecting movement perpendicular to the plane of the cover opening. Such a Form is particularly advantageous because it allows the first and second displacement body parts to be joined together quickly and efficiently, especially on the construction site.

In particular, the at least one displacement body can be formed as a hollow body, in particular as a hollow body filled with air. In particular, the displacement body can have a hard cover which surrounds a cavity that is filled, in particular, with a gas, such as air. This is particularly easy to implement if the at least one displacement body is composed of a first displacement body part and a second displacement body part, in particular directly at the location where the concreting is carried out. In particular, it can be provided that the at least one displacement body is not a foam body and/or is not filled with a foam and/or does not have a cover made of a foam.

Such a form can be produced in a particularly simple and cost-effective manner and, moreover, can be formed to be particularly robust with comparatively little use of material. The use of foam material can be problematic in order to achieve the required stability, particularly with regard to the design of the interstitial tube and in particular with a multi-part design of the displacement body. However, the use of foam is not Significantly excluded. In particular, it is not excluded that the at least one displacement body is a foam body and/or is filled with a foam and/or has a cover made of a foam. In particular, as mentioned above, it can advantageously be provided that the first displacement body part and the second displacement body part are of identical design. However, it is advantageously also possible for the first displacement body part and the second displacement body part to have a different height. Such a design is based on the independent inventive idea of achieving a particular variability with regard to the height of the displacement body in that otherwise identical displacement body parts, but with different height, can be connected to one another in order to form a displacement body in each case.

In this respect, it is possible, for example, to keep displacer parts ready which have two different heights and which are preferably otherwise identical. In this case, displacement bodies of three different heights can optionally be formed, since either only low displacement body parts can be connected to one another as first and second displacement body parts or, alternatively, only high displacement body parts can be connected to one another as first and second displacement body parts, or there is a third option with a high and one low displacement body part can be connected to one another as the first and second displacement body parts.

With a number of three different types of displacement body parts of different heights, a total of six different heights can be achieved through the different combination options. For example, an assortment of (preferably otherwise identical) displacement body parts with heights of 30 mm, 50 mm, 70 mm, 90 mm, 110 mm, 130 mm, 160 mm, 190 mm and 220 mm is particularly advantageous. With such a range, the height requirements for almost all concrete ceilings can be met. This procedure represents an independent inventive concept, which can also be advantageously implemented detached from the presence of a connection component that can be attached without tools and in particular also detached from the implementation of an interstitial tube and/or a connection component running through the interstitial tube. A corresponding assortment of connection components of different lengths is preferably also produced and kept ready.

In an advantageous embodiment, the displacement body has a plurality of protruding members on its outside, in particular upward and downward directed. The downwardly directed members can in particular act as feet which ensure that the displacement body does not fall over. The members also ensure in particular that adjoining reinforcement arrangements are kept at a distance from the outside of the displacement bodies. This ensures that the reinforcing bars of the reinforcement arrangement are surrounded by concrete in the required manner after concreting.

Starting from the outside of the displacement body, the members preferably have a height in the range from 10 mm to 25 mm, in particular in the range from 15 mm to 20 mm, in particular from 15 mm or from 20 mm.

The at least one displacement body can have on its outside at least one first bearing element with a receptacle, in particular formed as a trough, for a section of the first fixing element. Alternatively, or additionally, it can advantageously be provided that the displacement body has on its outside at least one second bearing element with a receptacle, in particular formed as a trough, for a section of the second fixing element. The bearing elements can be formed, for example, from crossed members, one of the crossed members each having a trough for a rod-shaped section of the first or the second fixing element. In this way it is advantageously ensured that the displacement bodies cannot move relative to the fixing elements.

In a particularly robust embodiment, the displacement bodies are disposed between the first fixing element and the second fixing element. This can be implemented, for example, in that the connecting component or the plurality of connecting components are formed in a manner that they continuously exert a force on the fixing elements directed towards the displacement body.

The connecting component is preferably a component that is separate and/or manufactured separately from the displacement body.

The first fixing element preferably has at least one rod, in particular a reinforcing rod. In particular, it can advantageously be provided that the first fixing element has a rod, in particular a reinforcing bar, which is part of a reinforcement grid, or that the first fixing element consists exclusively of a rod, in particular a reinforcing bar.

Alternatively, or additionally, it can advantageously be provided that the second fixing element has at least one rod, in particular a reinforcing rod. In particular, the second fixing element can have a rod, in particular a reinforcing rod, which is part of a reinforcement grid. It is also possible, for example, for the second fixing element to consist exclusively of a rod, in particular a reinforcing rod.

In a particular embodiment, the first fixing element and the second fixing element are arranged parallel to one another. Alternatively, or additionally, it can be provided that the first fixing element and second fixing element are arranged together in a plane which is a plane of symmetry of the at least one displacement body. In such an embodiment, assembly is particularly simple. In addition, such a design is particularly stable; this in particular also when the first fixing element and the second fixing element each consist exclusively of a single reinforcing bar.

As already mentioned, the concrete shaping insert according to the invention preferably has a plurality of displacement bodies each with an interstitial tube, the first fixing element and the second fixing element being connected to one another by a connecting component that proceed through one of the interstitial tubes. If the first and the second fixing element are formed as rods parallel to one another, the result is an elongated concrete shaping insert. In particular, several of these concrete shaping inserts can be arranged parallel to one another in a formwork. In particular, it can advantageously be provided that several displacement bodies are arranged, in particular disposed between the same first fixing element and the same second fixing element.

In a particular embodiment, adjacent displacement bodies are connected directly to one another with a displacement body connector. In particular, it can advantageously be provided that the displacement body connector can be attached without tools, in particular hooked or latched onto the displacement body.

According to an independent inventive concept, which can also be implemented independently of whether the displacement body has an interstitial tube and whether the first fixing element and the second fixing element are connected to one another with at least one connecting component that proceed through the interstitial tube, a concrete shaping insert is particularly advantageous, which has at least two displacement bodies which are arranged vertically one above the other in direct contact with one another and which have coupling devices that are cross-linked. It is advantageous, especially from a static and economic point of view, to arrange displacement bodies on top of one another when it comes to concreting building components with a corresponding thickness. For some concrete components, this variant is even more advantageous than using larger displacement bodies. In particular, it is also possible in this way to use concrete shaping inserts with the same displacement bodies for all concrete components when producing a building, the displacement bodies being arranged in one layer for the production of comparatively thin concrete components and in multiple layers, in particular two layers, one above the other for the production of thicker concrete components.

The coupling means advantageously prevent the displacement bodies from moving relative to one another, in particular during the concreting process. The coupling means can advantageously each have at least one projection and/or at least one depression. In particular, it can advantageously be provided that the coupling means of a displacement body is produced jointly in one piece with a cover of the displacement body.

In a particularly advantageous embodiment, the coupling means has at least one of the displacement bodies, in particular each displacement body, at least one protruding member arranged on the outside of the displacement body. In particular, the coupling means can comprise at least one of the displacement bodies, in particular each displacement body, a plurality of protruding members arranged on the outside of the displacement body. It can advantageously be provided here that at least two of the members run in planes which have an angle different from zero degrees to one another and/or which have a right angle (90 degrees) to one another. Such a design enables simple coupling of the displacement bodies and ensures a safeguard against displacement of the displacement bodies arranged one above the other in all horizontal spatial directions. Alternatively, or in addition, the members can advantageously be arranged in pairs parallel to one another. It is particularly advantageous if each displacement body has coupling means both on the upper side and on the lower side. This enables the use of identical parts. In addition, the coupling means (or the coupling means) on the underside of the lowermost displacement body can advantageously function as a stand (or as a stand).

The concrete shaping insert with displacement bodies arranged one above the other preferably has at least one fixing element which holds the displacement bodies in position relative to one another. In particular, it can advantageously be provided that the displacement bodies arranged one above the other are arranged, in particular disposed between a first fixing element and a second fixing element. The first fixing element and the second fixing element can be connected to one another by means of at least one connecting component.

A concrete shaping insert with displacement bodies arranged one above the other, in which the displacement bodies arranged one above the other have aligned interstitial tubes through which the connecting component that connects the first fixing element and the second fixing element runs, is particularly advantageous. In particular, the independent inventive concept can advantageously be implemented with one or more of the features described above.

A concrete component, in particular a concrete ceiling, which contains at least one concrete shaping insert according to the invention, is particularly advantageous.

In order to facilitate the assembly process, a positioning aid or a system of several positioning aids can be used according to an independent inventive concept. This aspect of the invention can advantageously be used when assembling concrete shaping inserts according to the invention, but also when assembling concrete shaping inserts not according to the invention.

The positioning aid is preferably formed and provided to temporarily hold at least one displacement body for an assembly process. In particular, the positioning aid can advantageously be formed to hold the displacement body in a manner that it stands upright and cannot accidentally tip over.

The positioning aid can have recesses which have specifically for (in particular, clamping) receiving, in particular protruding, parts of the displacement bodies and/or for receiving sections of the connecting component and/or for receiving one of the fixing elements.

In particular, the positioning aid can be formed as a plate which has the aforementioned recesses. The positioning aid can be made, for example, from a light material, in particular from a foam or a rigid foam.

In particular, it can advantageously be provided that several positioning aids can be connected to one another, in particular by means of a form-fit connection each. The form-fit connection can, for example, be formed similarly to puzzle pieces.

For example, a positioning aid can be formed to hold a single displacement body upright for an assembly process. By connecting a plurality of such positioning aids, a positioning aid system can be produced in a simple manner which is individually formed for the required number of displacement bodies to be connected.

The assembly process of the concrete shaping insert can then take place in a manner that positioning aids are first connected to one another in the required number and laid out on the floor. The first fixing element and the required connecting components are then inserted into the recesses provided for this purpose in the positioning aids. In a next step, the displacement bodies are positioned, the connecting component being guided through the Interstitial tube and protruding parts of the respective displacement body (e.g. protruding members and/or bearing elements) being introduced into the corresponding recesses of the respective positioning aid, so that the displacement body as a result is held upright by the positioning aid. The connecting components are then coupled to the second fixing element.

The finished concrete shaping insert can then be detached from the positioning aids and brought to the place intended for a concreting process. The positioning aids can then be used again for the assembly of the next concrete shaping insert. Finally, the positioning aids can be detached from each other again. The positioning aids can advantageously be stacked on top of one another for transport. All positioning aids are preferably formed in the same way.

BRIEF DESCRIPTION OF THE DRAWINGS

In the drawing, the subject matter of the invention will be explained in a representative and schematic manner, and will be described with reference to the drawings below, the elements that are the same or have the same effect are usually provided with the same reference items in different exemplary embodiments, that showing.

DETAILED DESCRIPTION

Figure 1:
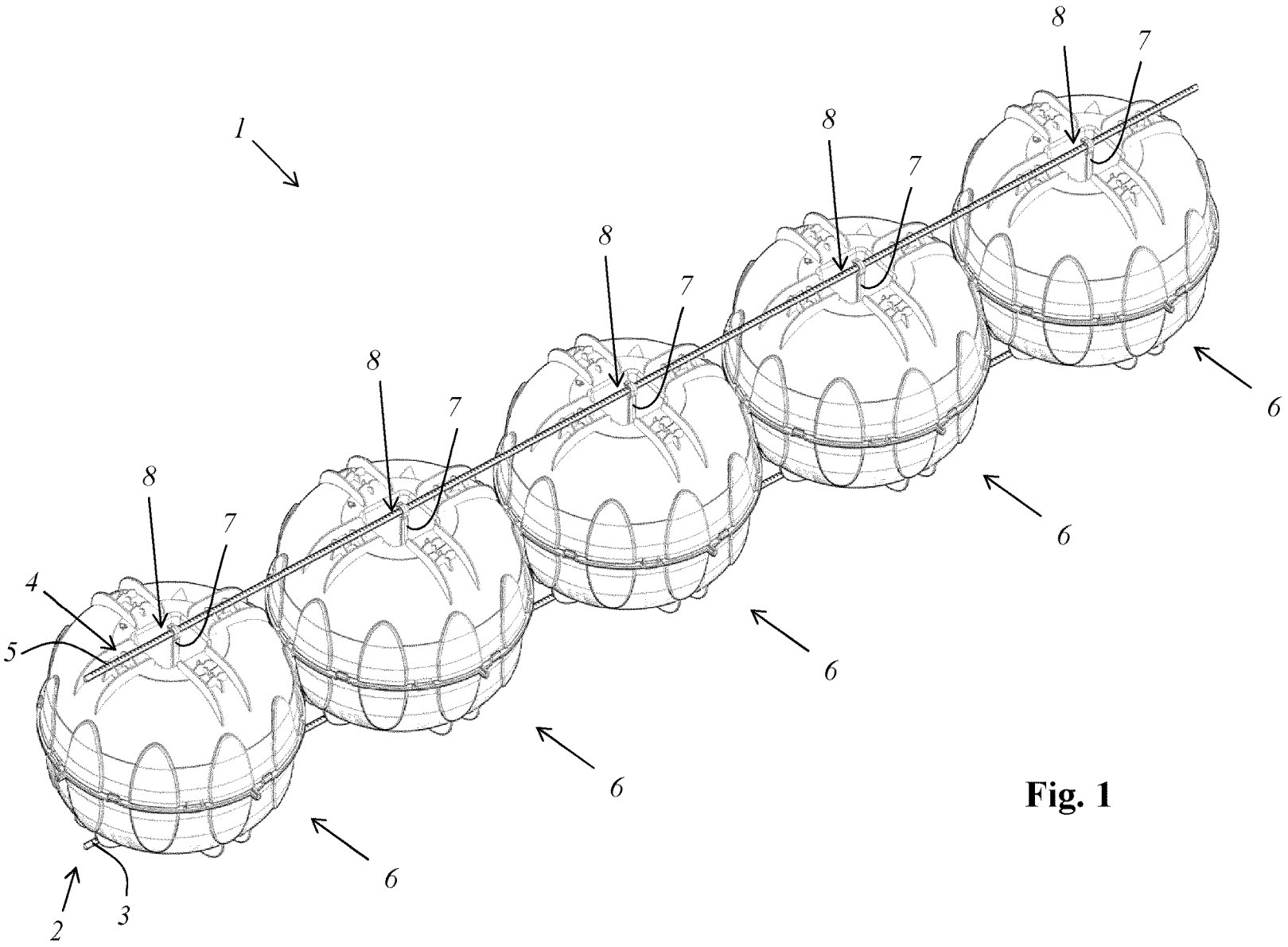
FIG. 1 shows a first embodiment of a concrete shaping insert according to the invention.

FIG. 1 shows a first embodiment of a concrete shaping insert 1 according to the invention, which is formed to be arranged in a formwork before a concreting process. The concrete shaping insert 1 has a first fixing element 2, which is formed as a first reinforcing bar 3.

The concrete shaping insert 1 also has a second fixing element 4, which is formed as a second reinforcing bar 5. The first reinforcing bar 3 and the second reinforcing bar 5 are arranged parallel to one another and lying vertically one above the other.

In addition, the concrete shaping insert 1 has a plurality of displacement bodies 6, which are arranged between the first fixing element 2 and the second fixing element 4.

The first fixing element 2 and the second fixing element 5 are connected to one another by means of a plurality of connecting components 7 that can be attached without tools. Each of the displacement bodies 6 has an interstitial tube 8 which one of the connecting components 7 passes through it.

Figure 2:
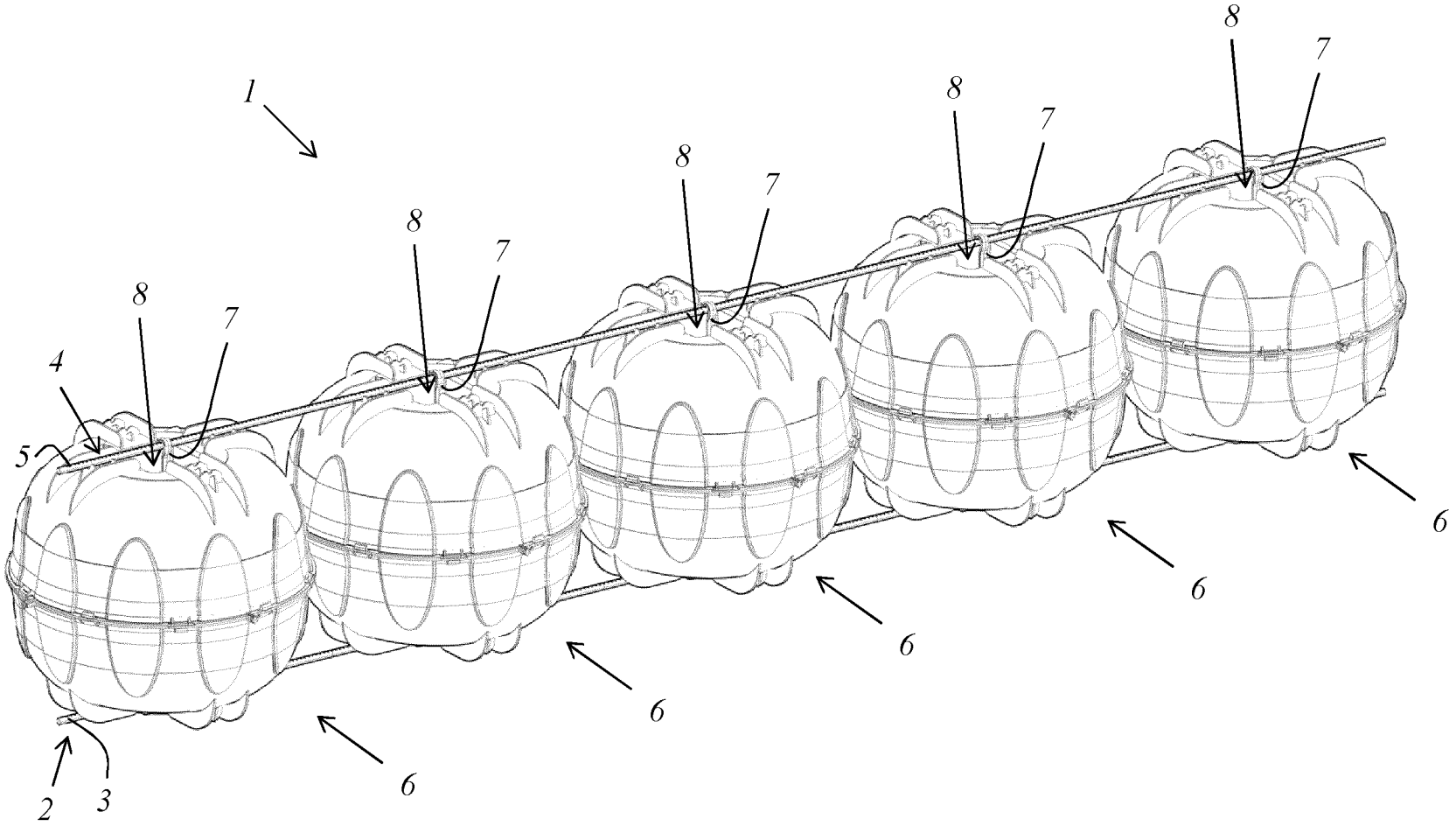
FIG. 2 shows a perspective view of the first embodiment of a concrete shaping insert.
Figure 3:
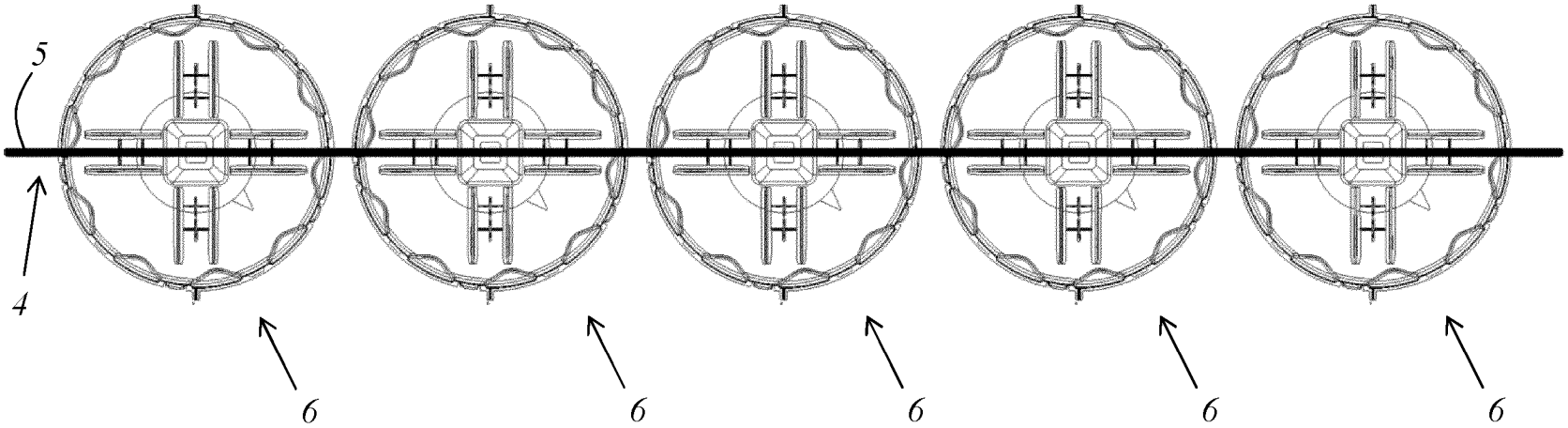
FIG. 3 is an upper schematic view of the first embodiment of the concrete formation insert 1.

FIG. 2 shows the concrete shaping insert in a perspective view from a different angle.

Figure 4:
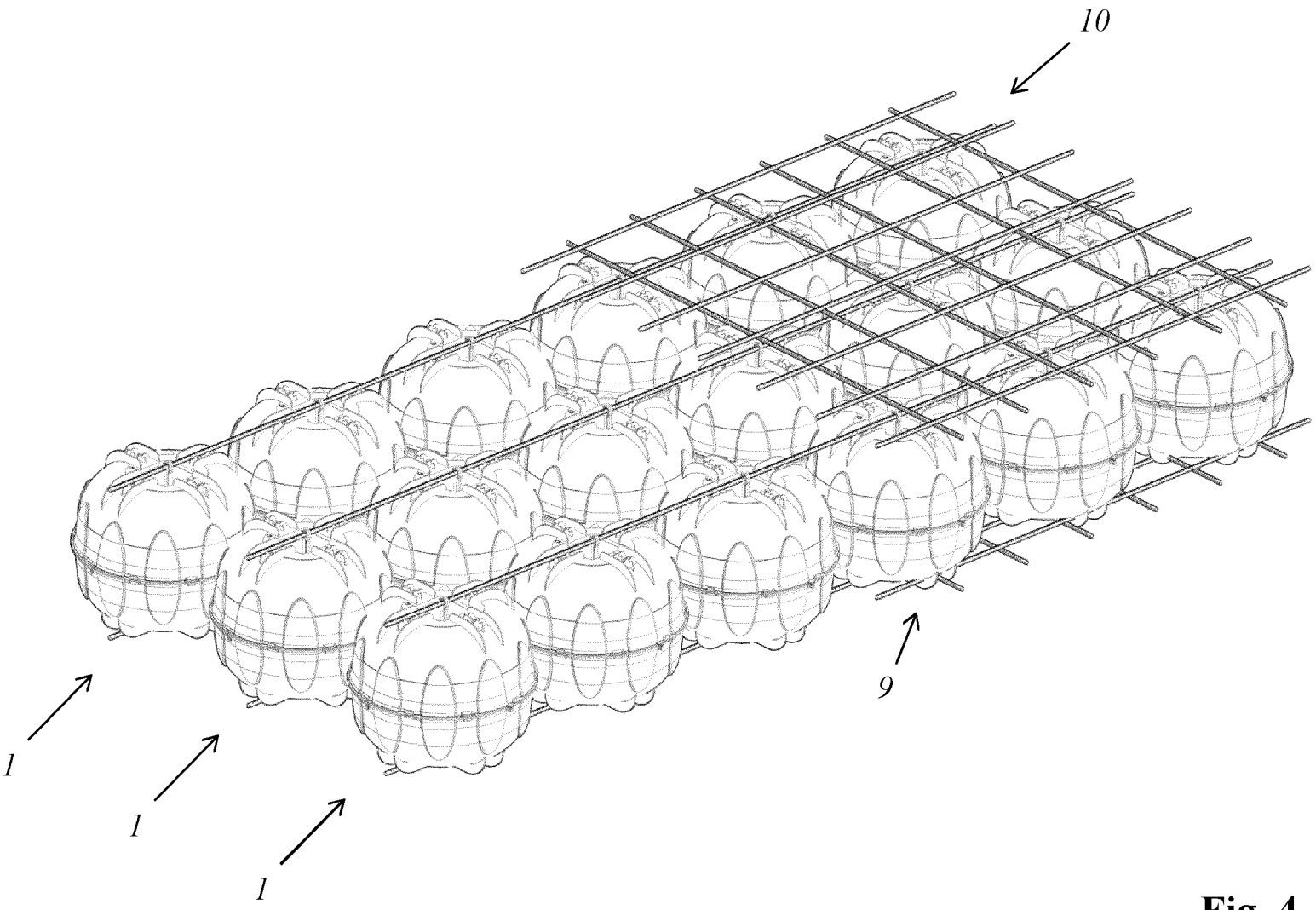
FIG. 4 is an arrangement for plurality of the concrete shaping inserts 1.

FIG. 4 shows an arrangement of several of the concrete shaping inserts 1 in a formwork (not shown). The concrete shaping inserts 1 are arranged on a first reinforcement arrangement 9, which is formed as a first reinforcement grid. In FIG. 4, the first reinforcement arrangement 9 is only partially shown for clarity. There is a second strengthening arrangement 10 through the concrete shaping inserts 1, formed as a second strengthening grid. The second reinforcement arrangement 10 is also only partially shown for clarity.

After the reinforcement arrangements 9, 10 and the concrete shaping inserts 1 have been arranged within the formwork (not shown), concrete can be poured into the formwork. In particular, it is also possible to carry out the concreting process in several time-spaced steps.

Figure 5:
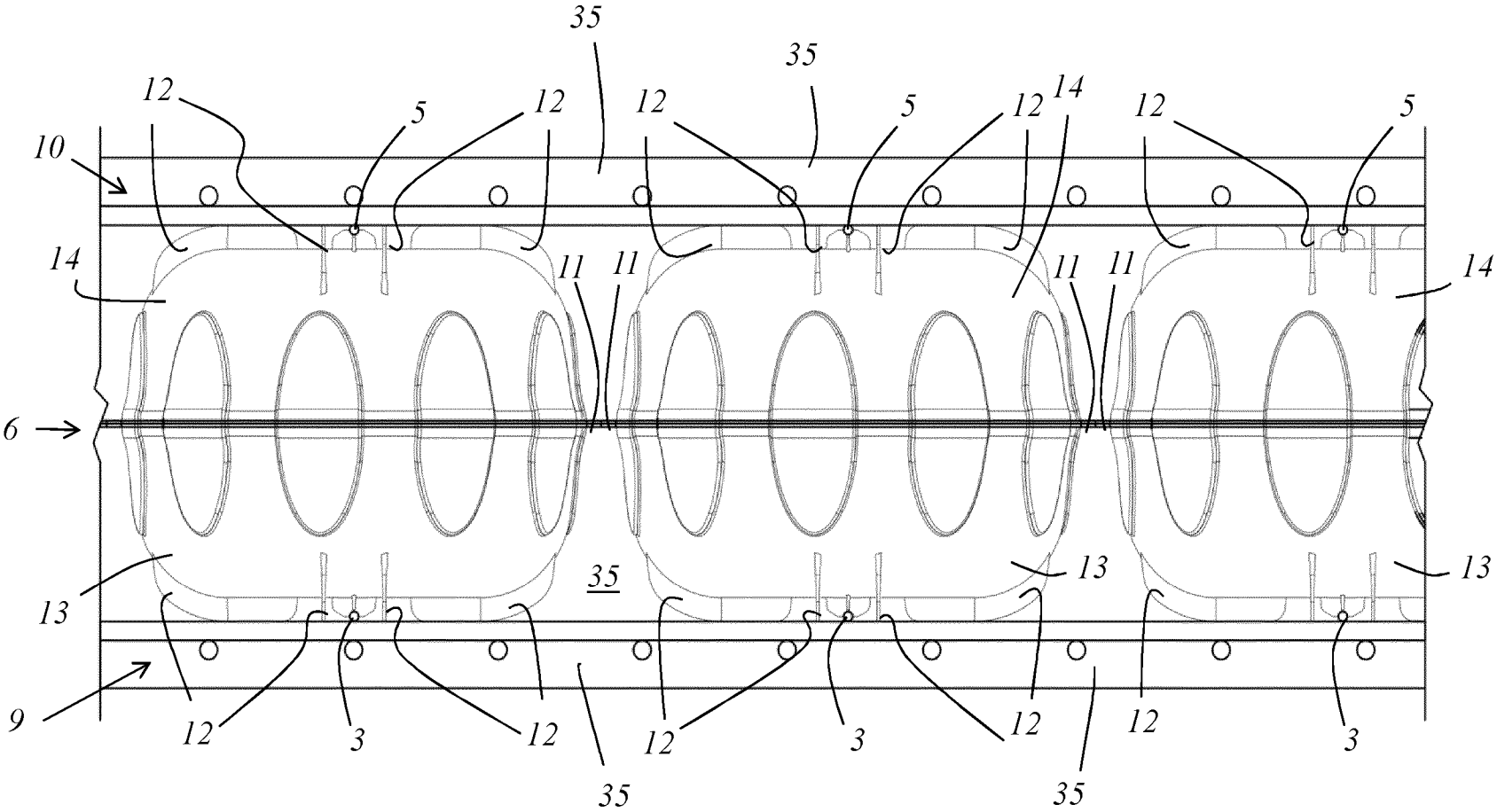
FIG. 5 is a cross-sectional view for a section of a concrete ceiling has a first embodiment of a concrete shaping insert according to the invention.

FIG. 5 shows, in a cross-sectional view, a detail from a concrete ceiling which contains a concrete shaping insert 1 according to the invention. The concrete shaping insert 1 is arranged between the first reinforcement arrangement 9 and the second reinforcement arrangement 10.

Each of the displacement bodies has four pin-shaped spacers 11, which are evenly distributed along its equatorial circumference, which ensure that the desired distance between the displacement bodies 6 of the concrete shaping inserts 1 and the displacement bodies 6 of the adjacent concrete shaping inserts 1 (not shown) is maintained.

Each of the displacement bodies 6 is composed of a first displacement body part 13 and a second displacement body part 14, which is explained in detail below.

Each of the displacement bodies 6 has on its outside protruding members 12 arranged in a cross-like manner in pairs, which, starting from the outside of the respective displacement body 6, have a height preferably in the range of 10 mm to 25 mm, in particular 15 mm. The members 12 ensure in particular that the reinforcement arrangements 9, 10 are kept at a distance from the outside of the displacement bodies 6, so that it is ensured that the reinforcing bars of the reinforcement arrangement 9, 10 are surrounded by concrete 35 in the required manner. The lower members 12 also function as feet, which ensure that the displacement body 6 does not fall over.

The spaces between the displacement bodies 6 and the spaces above and below the concrete shaping insert 1 are completely filled with concrete 35, so that the reinforcement arrangements 9, 10 are also completely enclosed in concrete 35.

Figure 6:
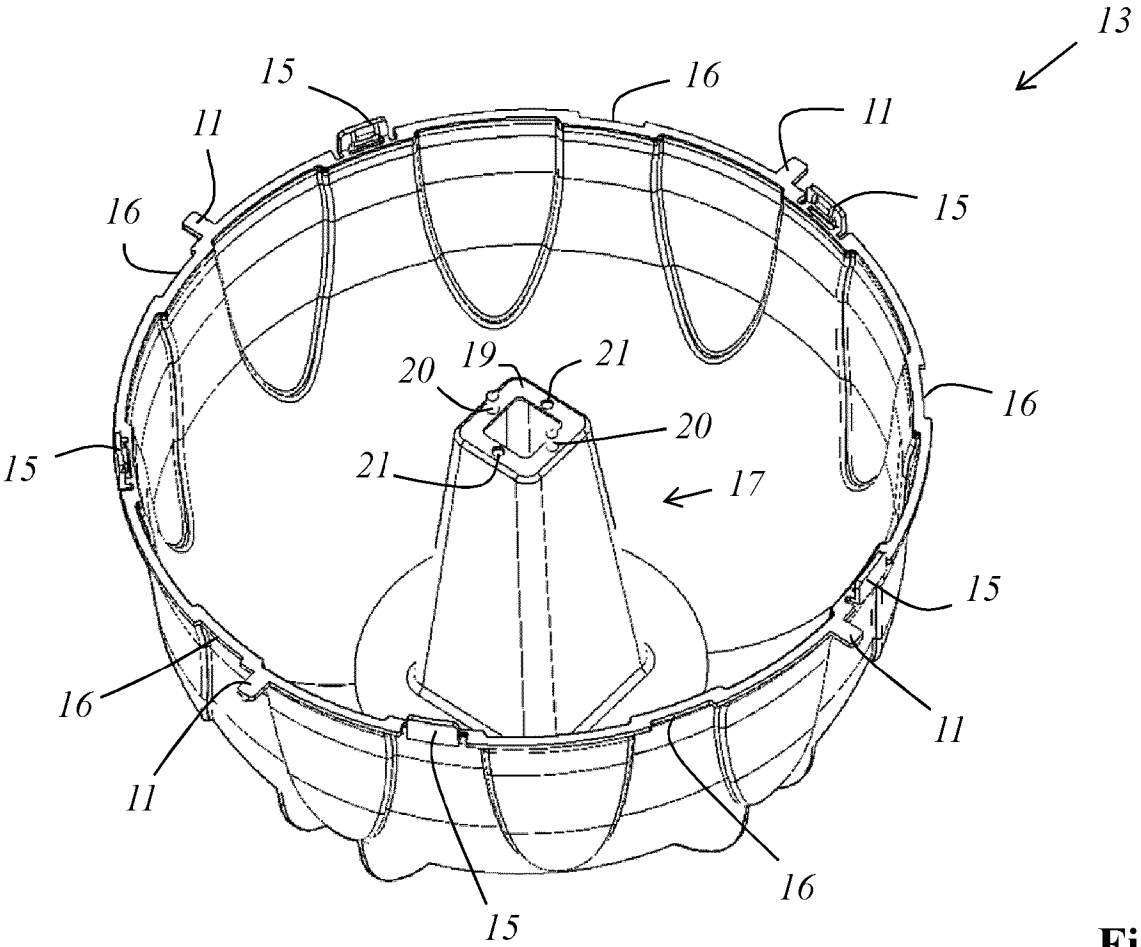
FIG. 6 shows an embodiment of a first displacement body part for the displacement body of a concrete shaping insert according to the invention.
Figure 7:
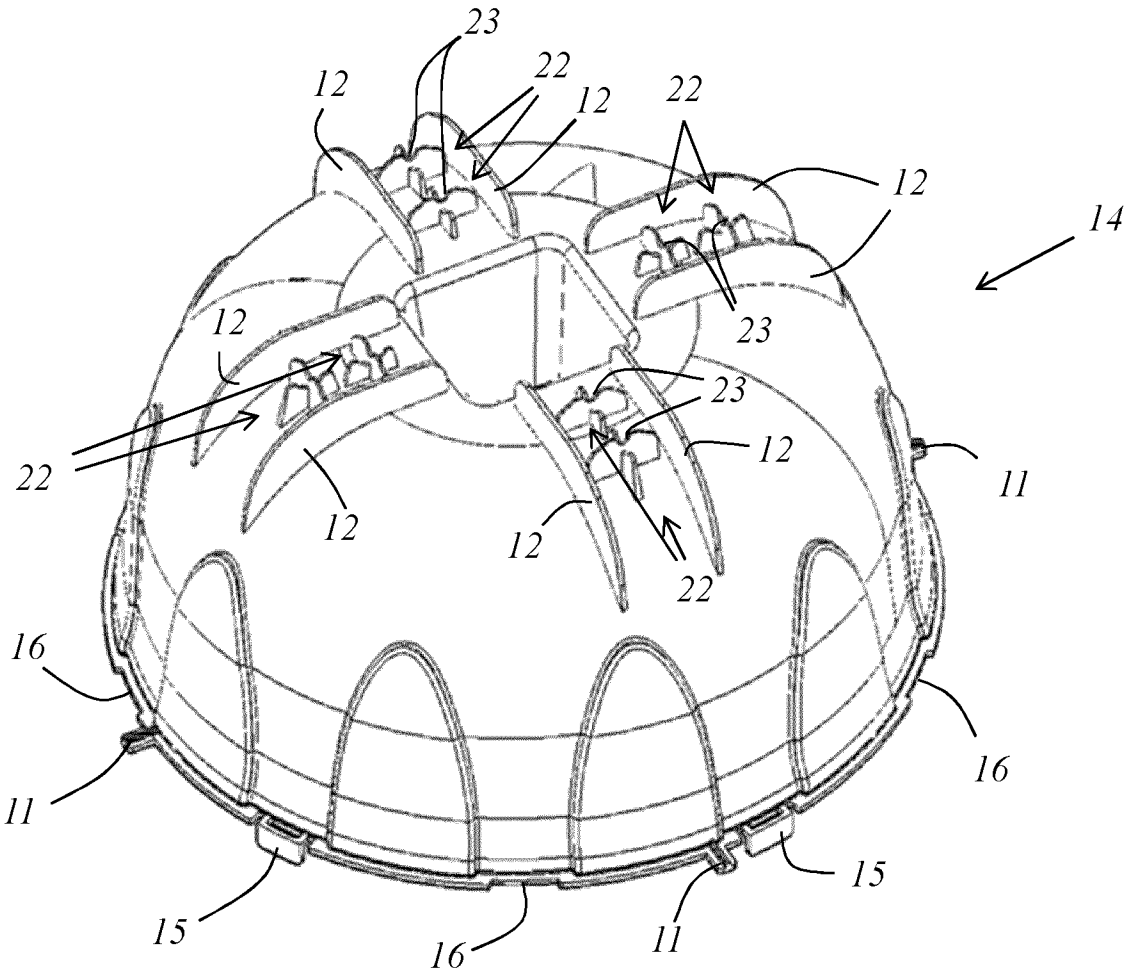
FIG. 7 shows an embodiment of a second displacement body part for the displacement body of a concrete shaping insert according to the invention.

FIG. 6 shows an example of a first displacement body part 13, which can be assembled with the second displacement body part 14 shown in FIG. 7 without tools, namely by a latching process, to form a displacement body 6.

The first displacement body part 13 shown in FIG. 6 is key-shaped and has a first connecting device on the circumferential edge of the opening, which alternately includes latching tabs 15 and latching projections 16 on the circumferential edge.

Figure 11:
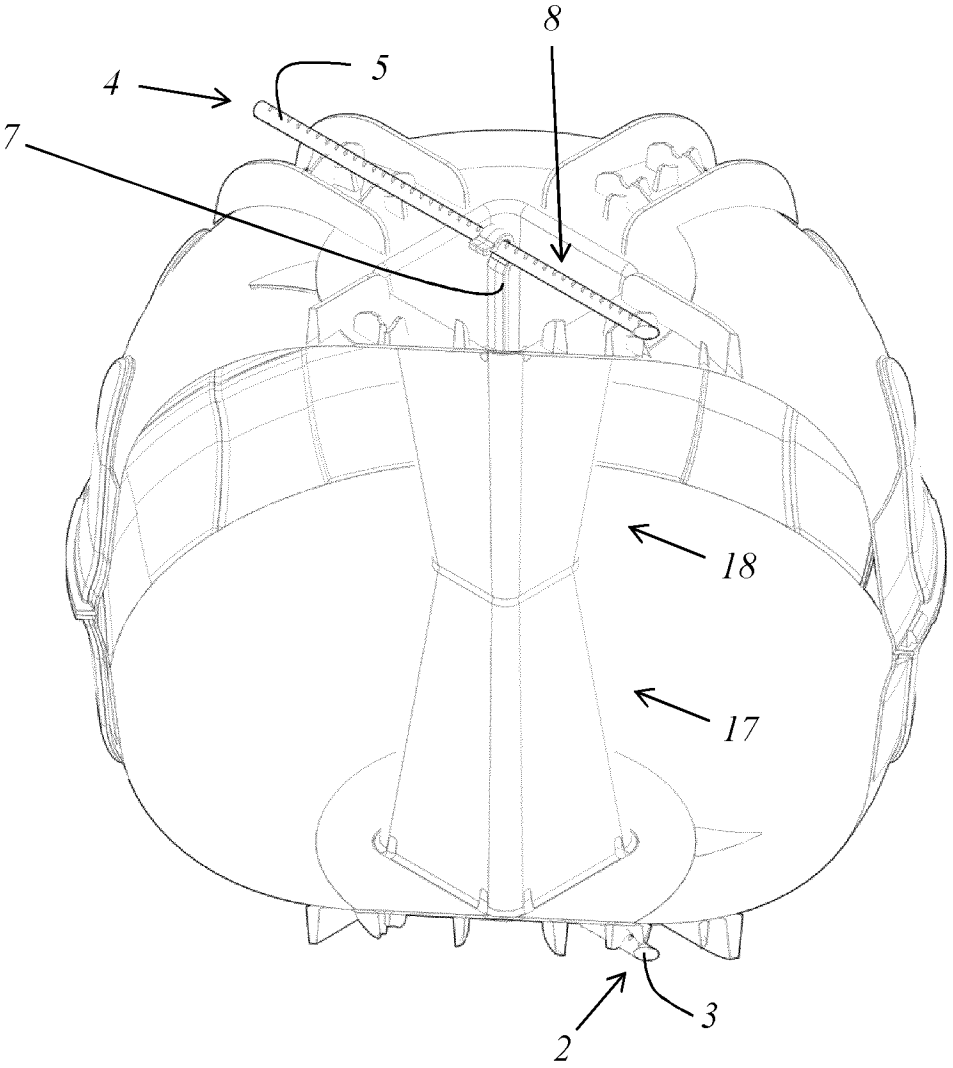
FIG. 11 shows the displacement body disposed between the first fixing element and the second fixing element in a representation that allows a look into the interior.
Figure 12:
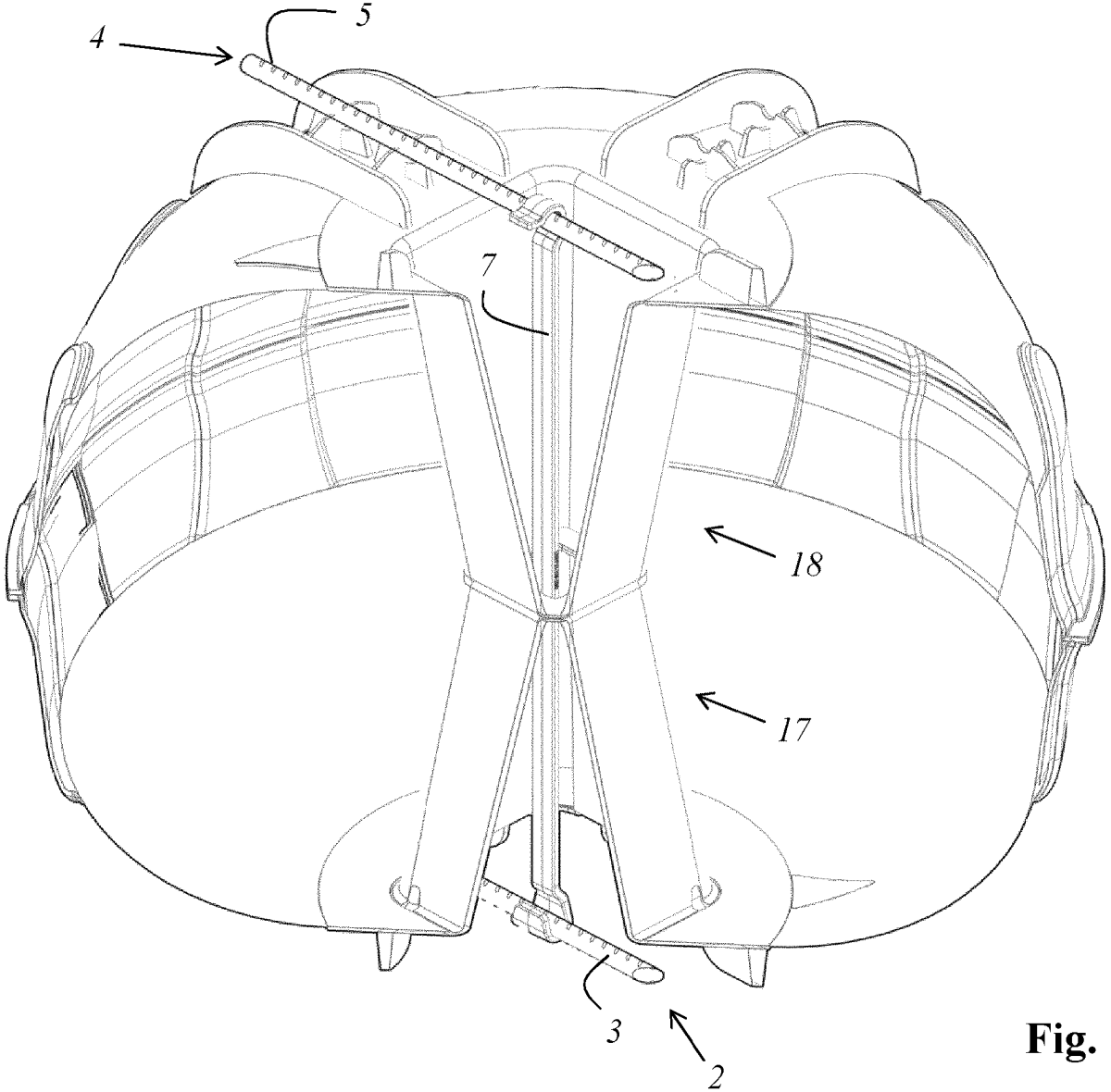
FIG. 12 shows a further detailed view, which allows to see the interior of interstitial tube.

The first displacement body part 13 has a first interstitial tube part 17 which, together with a second interstitial tube part 18 of a second displacement body part 14, as shown for example in FIG. 7, forms the interstitial tube 8 of the displacement body 6, which is shown in detail in FIGS. 11 and 12 is shown.

The first interstitial tube part 17 has a first contact surface 19 at the end. The contact surface 19 has two pins 20 and also has two through holes 21. The pins 20 and the through holes 21 serve to produce a form-fit connection with the complementary second interstitial tube part 18 of a second displacement body part 14.

The first displacement body part 13 has four protruding spacers 11 distributed uniformly on the outer circumferential edge, which, in the assembled state, come into contact with corresponding spacers 11 of the second displacement body part 14. The spacers 11 ensure that the desired distance between the displacement bodies 6 of the concrete shaping inserts 1 and the displacement bodies 6 of adjacent concrete shaping inserts 1 is maintained. For this purpose, provision is made for the displacement bodies 6 to be arranged such that the free ends of the spacers 11 of adjacent displacement bodies 6 adjacent to each other.

The first displacement body part 13 has on its outside (not shown in FIG. 6) protruding members 12 which, as already explained, ensure the necessary spacing from adjacent reinforcements. In addition, the members 12 act as feet and ensure that the displacement body 6 can safely stand.

The second displacement body part 14 has a plurality of bearing elements 22 (not shown in FIG. 6) on its outside, which are formed to interact with the first fixing element 2. The bearing elements are formed exactly as in the case of the second displacement body part 14 shown in FIG. 7.

FIG. 7 shows a second displacement body part 14 which, in this exemplary embodiment, has the same design as the first displacement body part shown in FIG. 6. This is advantageous with regard to the use of identical parts. However, this is not absolutely necessary. On the contrary, it can also be advantageous if the first displacement body part 13 and the second displacement body part 14 are not formed to be completely identical, but at least differ in height, which is explained in detail below.

The second displacement body part 14 has on its outside protruding members 12 which, as already explained, ensure the necessary spacing from adjacent reinforcements. The second displacement body part 14 has latching tabs 15 and latching projections 16 that alternate around the circumference of the opening. The locking tabs 15 of the second displacement body part 14 are formed to interact with the locking projections 16 of the first displacement body part 13, while the locking projections 16 of the second displacement body part 14 are formed to interact with the locking tabs 15 of the first displacement body part 13.

The first displacement body part 13 and the second displacement body part 14 can be connected to one another in a latching manner by executing a connecting movement perpendicular to the plane of their cover openings by means of the latching tabs 15 and the latching projections 16 of the connecting devices.

The second displacement body part 14 has a plurality of bearing elements 22 on its outer side which are formed to interact with the second fixing element 4. The bearing elements 22 each consist of crossed members, one of the crossed members each having a depression 23 for the second fixing element 4, which is formed as a reinforcing bar 5. The bearing elements 22 are each arranged between two mutually parallel members 12 and are dimensioned such that the inserted second fixing element 4 does not protrude upward beyond the members 12.

There is a total of four pairs of bearing elements 22, only four of the bearing elements 22 being required when using a second fixing element formed as a reinforcing bar, which are arranged in two pairs and in a straight line on both sides of the opening of the tube 8. The four other bearing elements 22, which are arranged along a straight line, which are arranged perpendicular to the straight line along which the bearing elements 22 used are arranged, are not required when using a second fixing element which is formed as a reinforcing bar.

However, the special arrangement of the bearing elements makes it possible to use a first displacement body part 13 as a second displacement body part 14 and vice versa. In this respect, a rotationally symmetrical design of the displacement body parts 13, 14 with respect to the central axis running through the interstitial tube 8 is particularly advantageous. In the present case, the displacement body parts 13, 14 have fourfold rotational symmetry. This principle can also be implemented advantageously when the displacement body parts have different heights.

Figure 8:
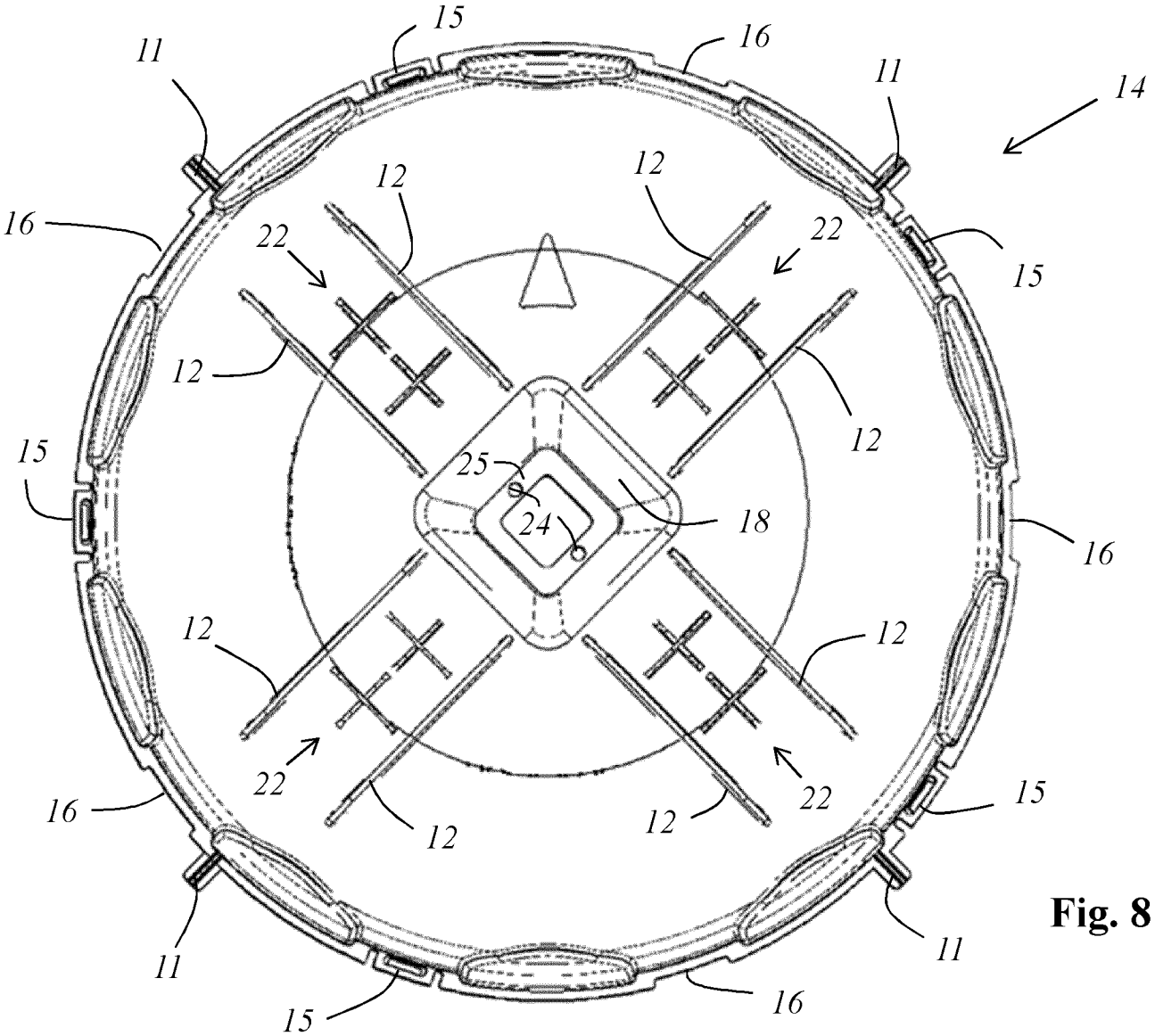
FIG. 8 is a top view diagram of the second displacement body part 14.

FIG. 8 shows the second displacement body part 14 in a plan view from above.

The second displacement body part 14 has, as already mentioned, a second interstitial tube part 18 which, together with the first interstitial tube part 17 of the first displacement body part 13, forms the interstitial tube 8. The second interstitial tube part 18 has a circumferential collar 25 at the end, which has two second passage openings 24. The first pins 20 of the first displacement body part 13 can engage positively in the through openings 24. The collar 25 for its part carries pins (not shown in this figure) which engage in the through openings 21 of the first displacement body part 13. On the side not shown in FIG. 8, the circumferential collar 25 provides a second contact surface which is in contact with the first contact surface 19 of the first displacement body part 13.

Figure 9:
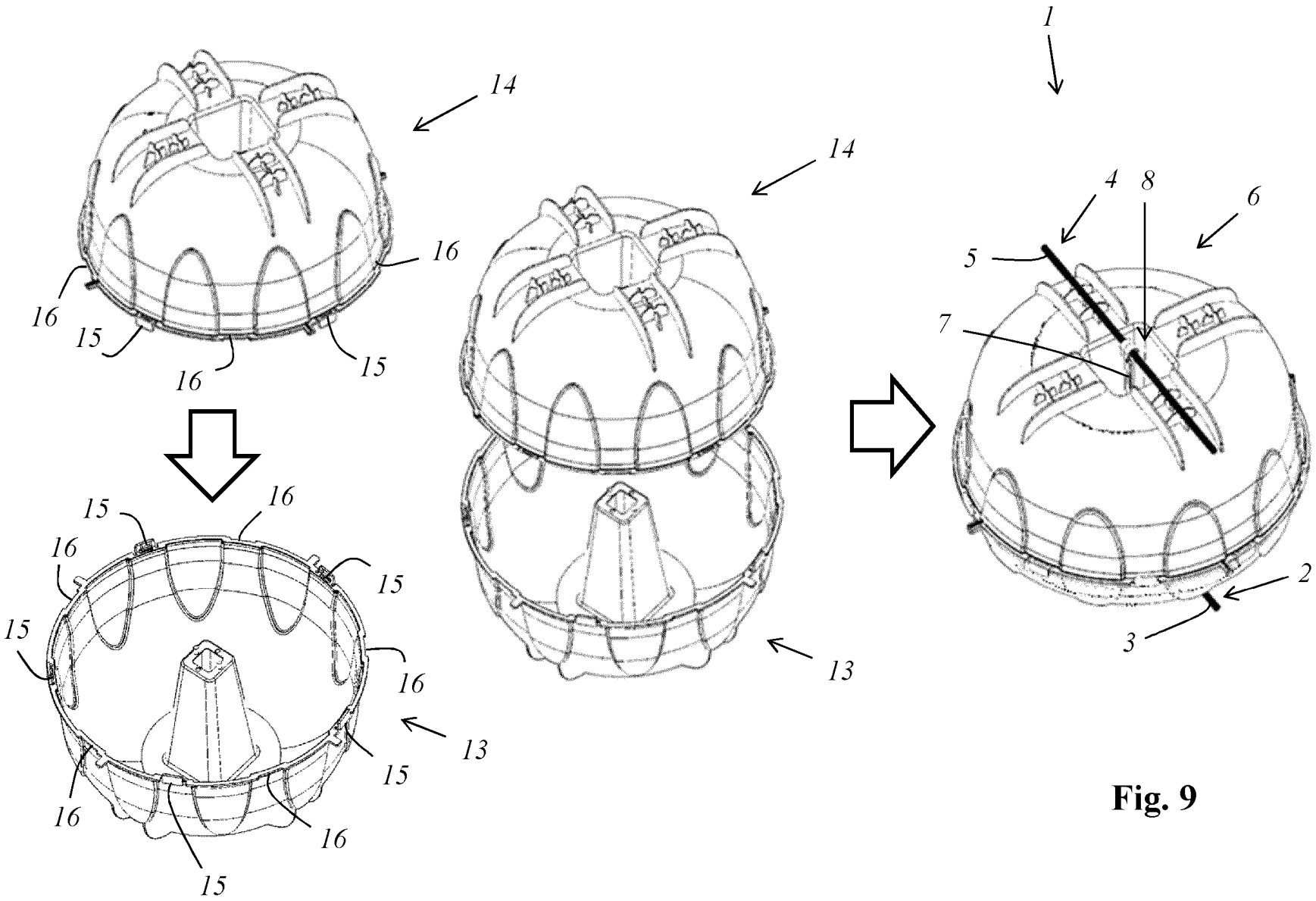
FIG. 9 shows an illustration of a potential procedure for producing a concrete shaping insert according to the invention.

FIG. 9 illustrates a potential procedure for producing a concrete shaping insert 1 according to the invention. For this purpose, a first displacement body part 13 is connected in a latching manner to a second displacement body part 14, a connecting movement being carried out perpendicular to the plane of the cover openings.

During the locking process, the locking tabs 15 and the locking projections 16 lock into one another. At the same time, the first contact surfaces of the first interstitial tube part 17 and the second interstitial tube part 18 come into contact with one another, with a form-fit connection, namely a tongue joint, being established between the first interstitial tube part 17 and the second interstitial tube part 18.

The displacement body 6 is then disposed between a first fixing element 2 and a second fixing element 2 by connecting the fixing elements 2, 4 without tools by means of a connecting component 7 that proceed through the interstitial tube 8.

Figure 10:
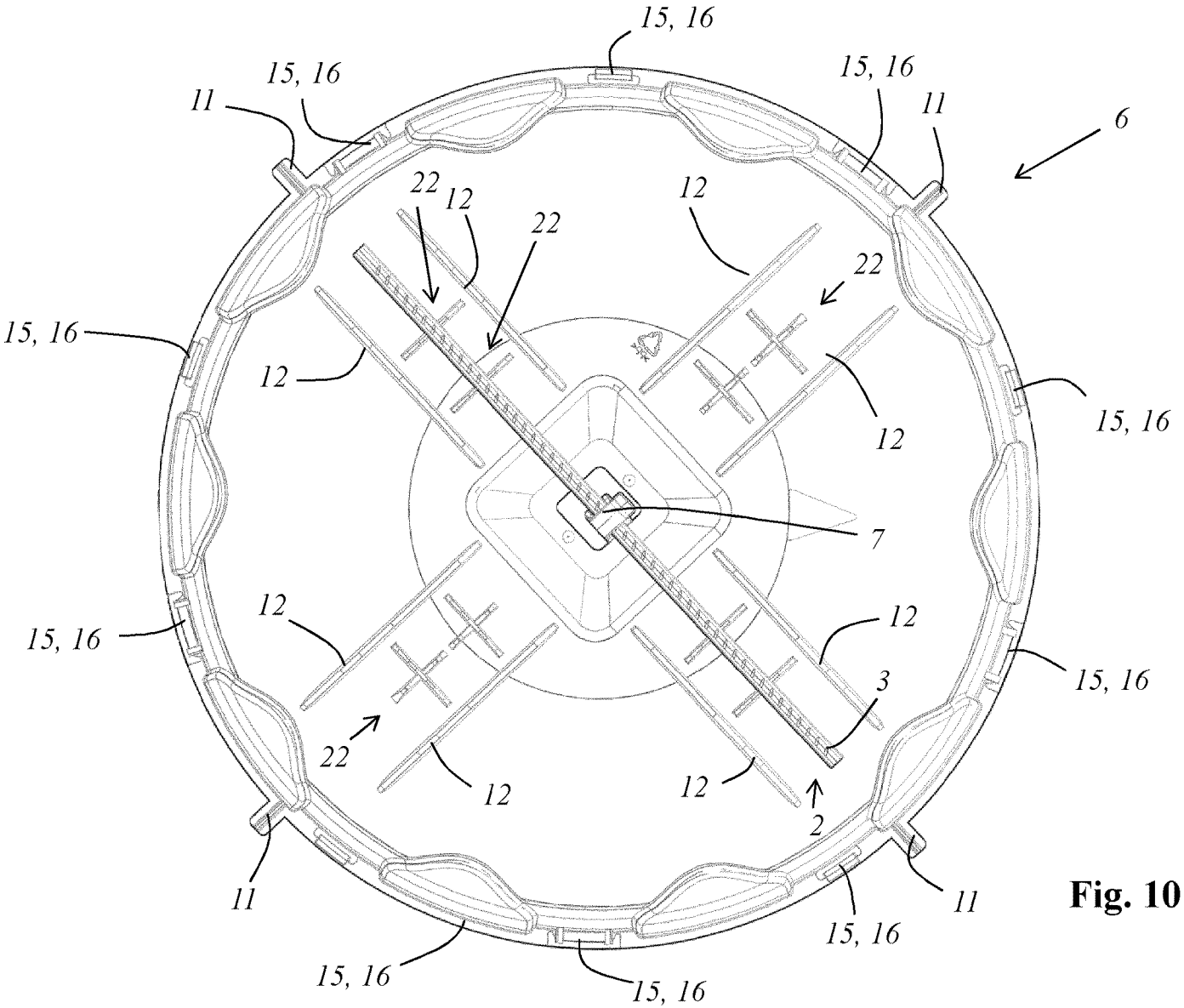
FIG. 10 shows a top view for the displacement body disposed between a first fixing element and a second fixing element.

FIG. 10 shows the displacement body 6 disposed between the first fixing element 2 and the second fixing element 4 in a plan view from below, only a portion of the reinforcing bar 3, which forms the first fixing element 2, being shown so as not to close the spacers 11 in the form cover up.

FIG. 11 shows the displacement body 6 disposed between the first fixing element 2 and the second fixing element 4 in a representation that allows a view into the interior. It can be seen in particular that the first interstitial tube part 17 and the second interstitial tube part 18 bear against one another and together form the interstitial tube 8. The interstitial tube 8 has, in a cross-sectional plane perpendicular to its direction of longitudinal extension, a shape that deviates from the circular shape, namely a square shape.

FIG. 12 shows a further detailed view which allows a view into the interior of the interstitial tube 8 through which the connecting component 7 proceeds.

Figure 13:
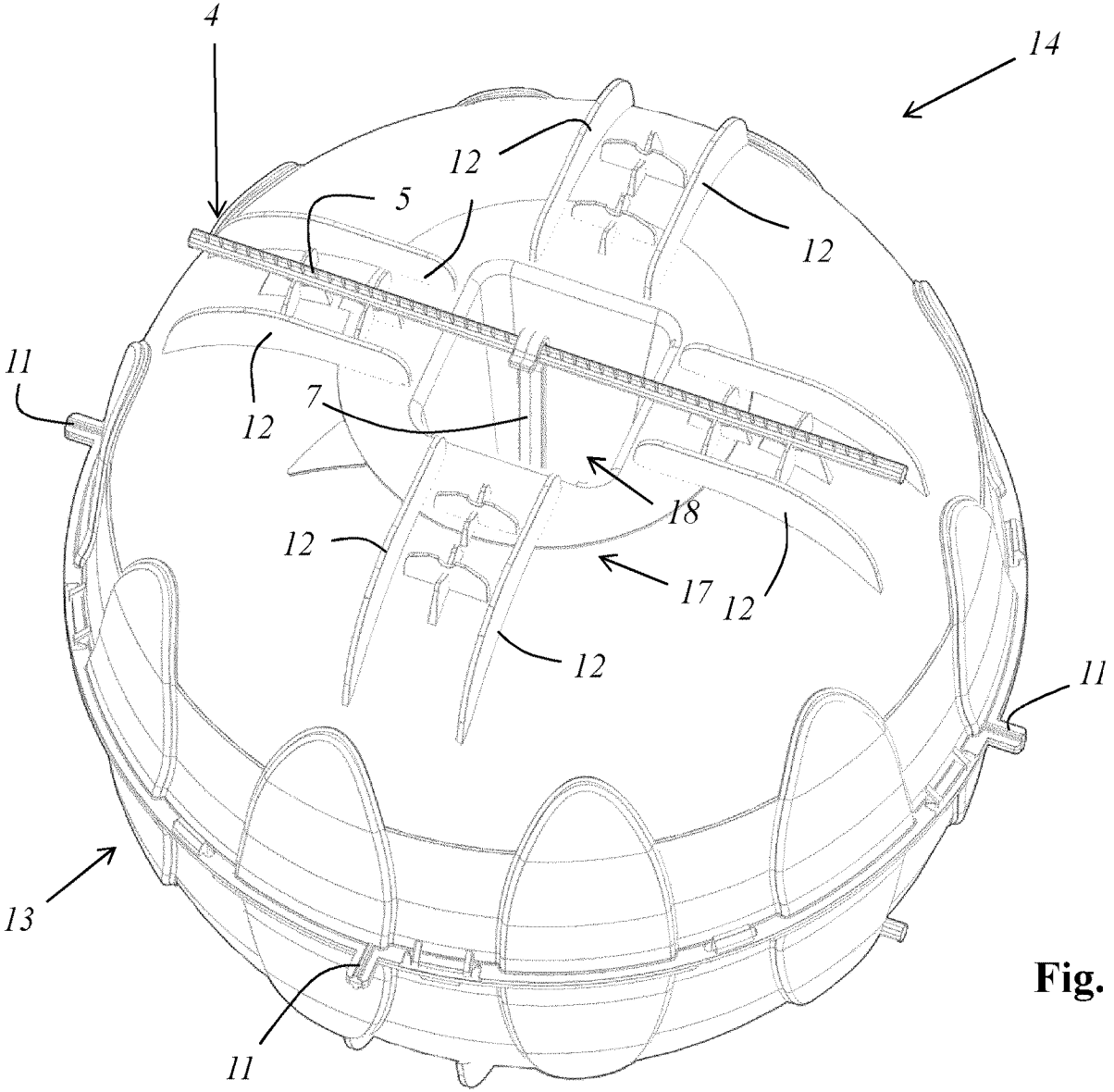
FIG. 13 shows a detailed view of a second embodiment of a concrete shaping insert according to the invention.
Figure 14:
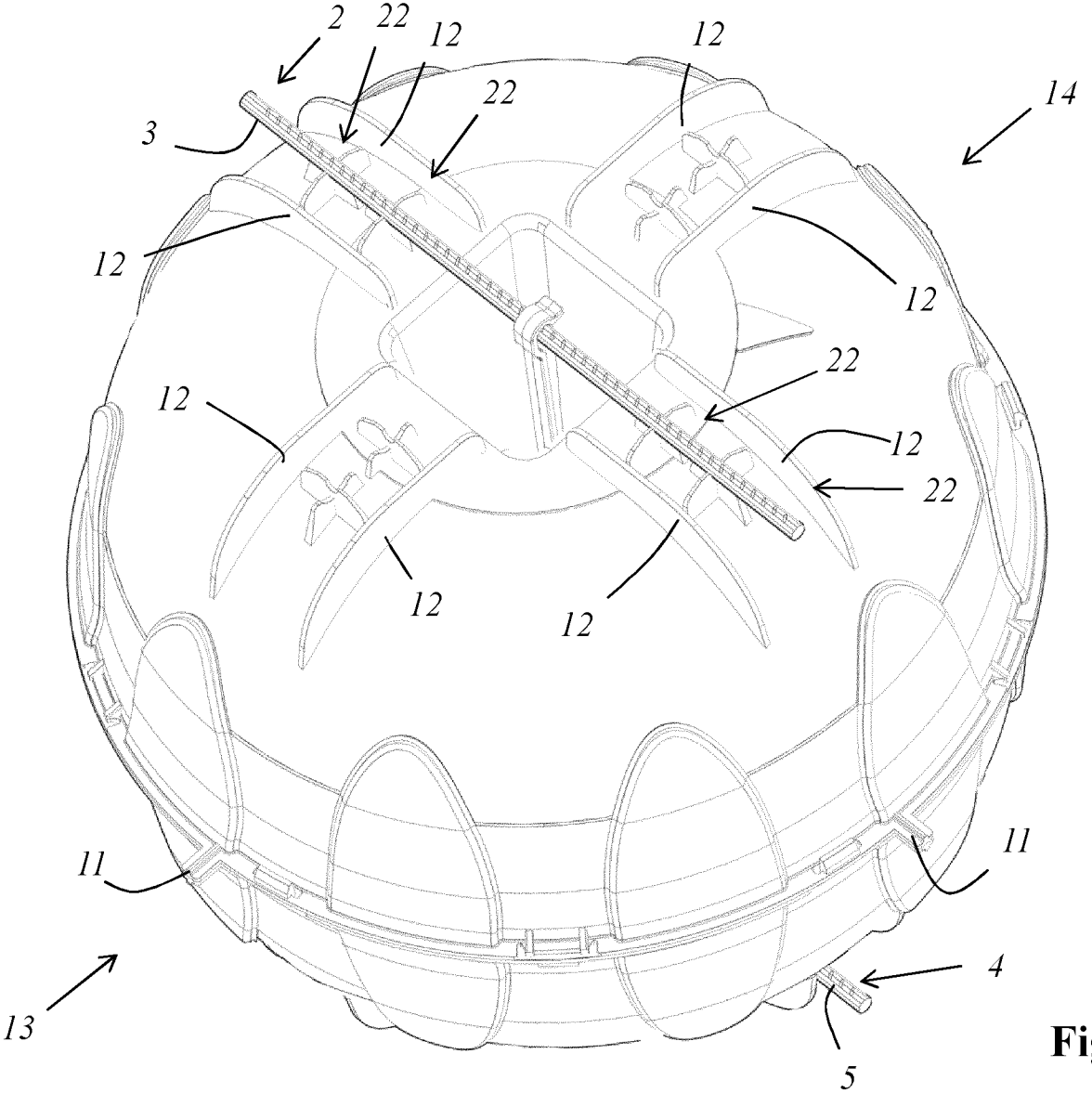
FIG. 14 shows a further detailed view of the second exemplary embodiment of a concrete shaping insert according to the invention.

FIGS. 13 and 14 show details of a second embodiment of a concrete shaping insert 1 according to the invention. In contrast to the embodiment shown in FIGS. 1 to 12, the first displacement body part 13 and the second displacement body part 14 are not formed the same in this embodiment, but differ in terms of their height in the direction of the longitudinal extent of the interstitial tube. In this embodiment, the first displacement body part 13 can for example have a height of 110 mm, while the second displacement body part 14 has a height of for example 50 mm.

However, the first connecting device of the first displacement body part 13, the second connecting device of the second displacement body part 14 are the same and are formed in a manner, in particular rotationally symmetrical, that it is possible to selectively connect only lower displacement body parts 13, 14, for example 50 mm in height, in order to achieve a result To achieve displacement body 6 with a total height of 100 mm, or exclusively to connect higher displacement body parts 13, 14 of for example 110 mm height with each other in order to achieve a displacement body 6 with a total height of 220 mm, or (as in the present example) lower and to connect higher displacement body parts 13, 14 to one another in order to achieve a displacement body 6 with a total height of 160 mm as a result.

In this way, a total of three different heights can be achieved through the different possible combinations of only two types of displacement body parts 13, 14. With a number of three different displacement body parts 13, 14 of different heights, a total of six different heights can be achieved through the different possible combinations. This procedure represents an independent inventive concept, which can also be advantageously implemented detached from the presence of a connection component that can be attached without tools and in particular also detached from the implementation of an interstitial tube 8 and/or a connection component 7 proceed through the interstitial tube.

Figure 15:
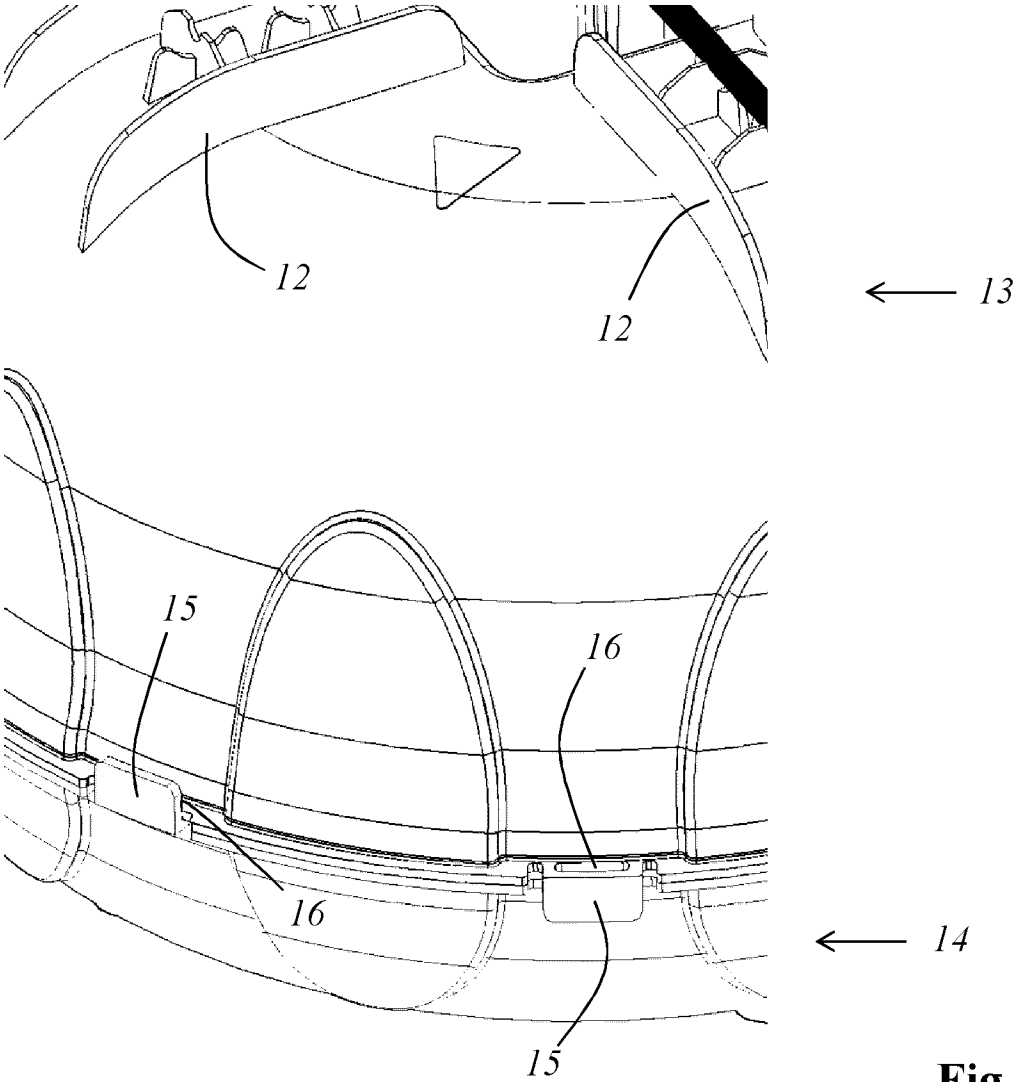
FIG. 15 is a detailed view of an assembled displacement body of the second embodiment.

FIG. 15 shows a detailed view of the assembled displacement body 6 with a total height of 160 mm.

Figure 16:
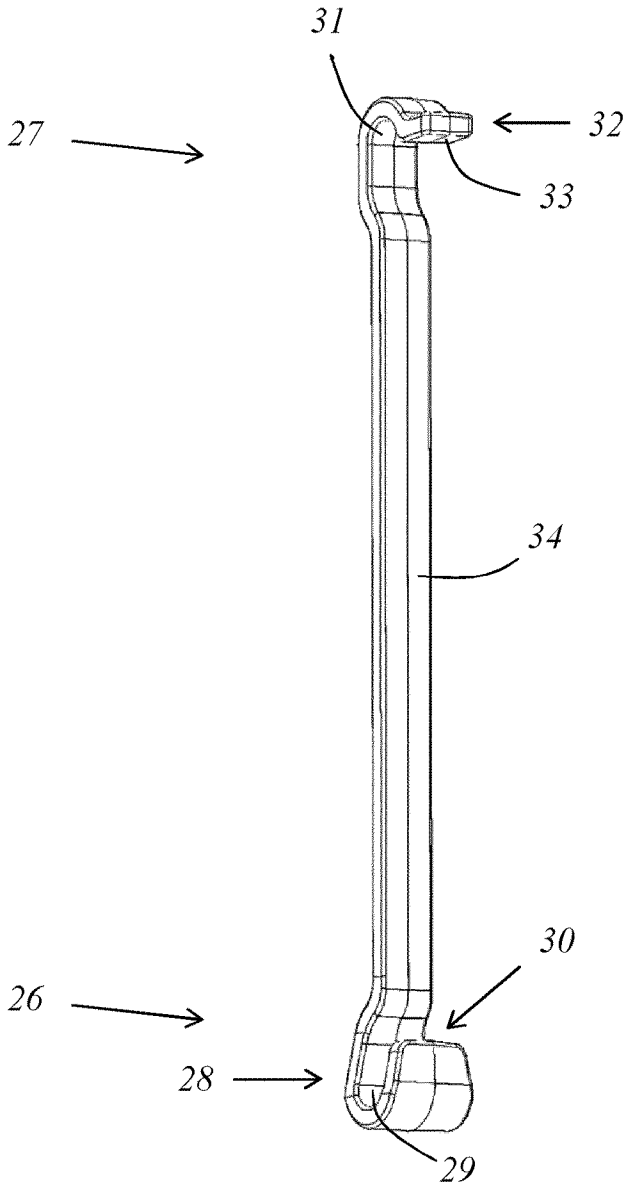
FIG. 16 is an embodiment of a tool-free attachable connecting component.

FIG. 16 shows an exemplary embodiment of a connecting component 7 that can be attached without tools from which, the first fixing element 2 and the second fixing element 4 can be connected to one another. The connecting component 7 has a first connecting element 26 which is formed for mechanical coupling to the first fixing element 2. In addition, the connecting component 7 has a second connecting element 27, which is formed in particular for mechanical coupling to the second fixing element 4. The first connecting element 26 is formed as a latching device and has an elastic locking hook 28. The locking hook 28 is formed to grip around a rod-shaped section of the first fixing element 2, in particular in a form-fitting manner. For this purpose, the elastic locking hook 28 has a receptacle 29 for the rod-shaped section of a first fixing element 2 and an insertion gap 30 through which the rod-shaped section of the first fixing element 2 can be inserted into the receptacle 29. The passage width of the insertion gap 30 is smaller than the inner diameter of the receptacle 29. In this way it is ensured that the connecting component 7 cannot automatically detach itself from the first fixing element 2 after it has snapped into place. This is especially not the case if the second connecting element 27 has not yet been connected to the second fixing element 4. Rather, the first connecting element 26 is advantageously formed in a manner that the connecting component 7, after it has been connected to a rod-shaped section of the first fixing component 2, can be pivoted about the rod-shaped section without inadvertently detaching from the rod-shaped section.

The second connecting element 27 is also formed as a latching device and has an elastic locking hook with an indentation 31 for a rod-shaped section of the second fixing element 4. A guide element 32 with a guide surface 33 adjoins the indentation 31.

The connecting component 7 has an elongate web 34. The first connecting element 26 is arranged at one end of the web. The second connecting element 27 is arranged at the other end of the web 34.

Figure 19:
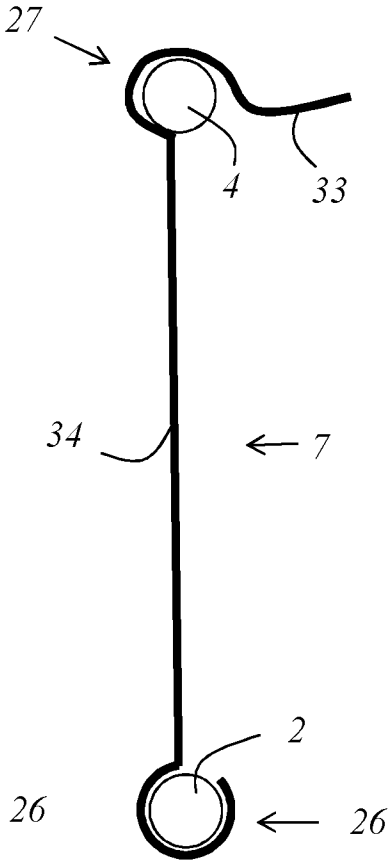
Figure 18:
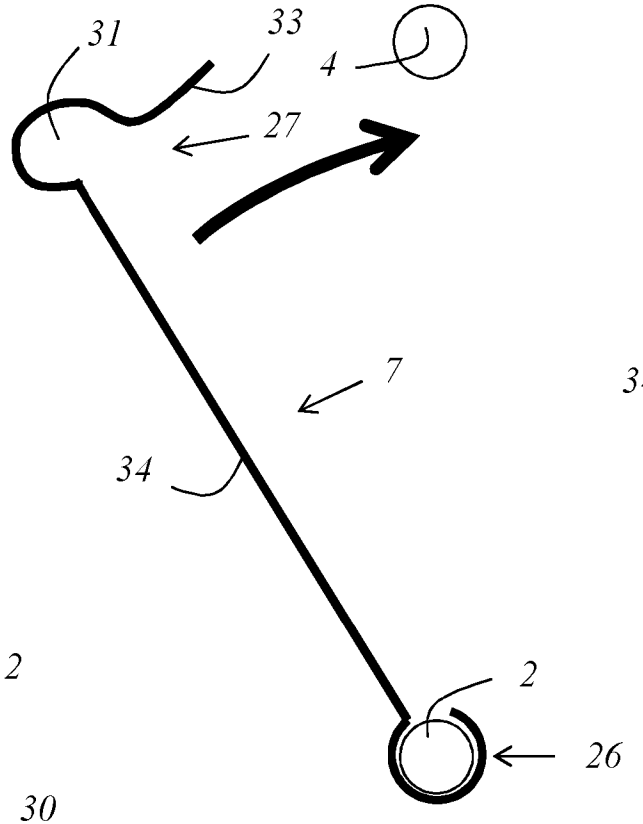
Figure 17:
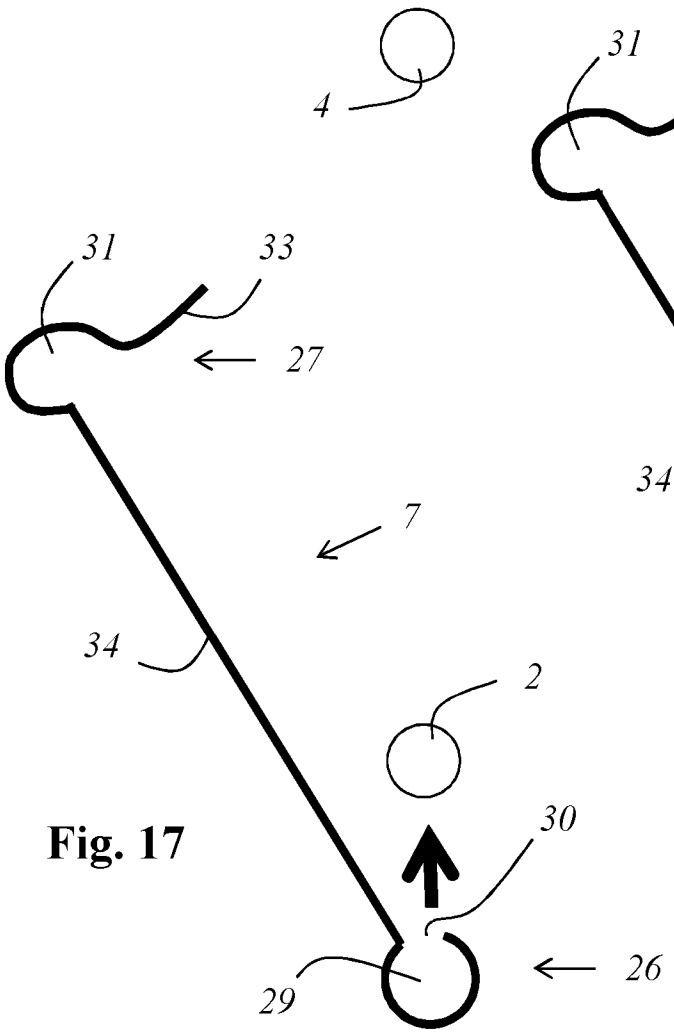
FIG. 17 is an illustration of how the connector is used, FIG. 18 another illustration of how the connector is used, FIG. 19 another illustration of how the connector is used.

FIGS. 17 to 19 illustrate schematically how the connecting component is used.

for clarity, the first connecting element 26 is latched to a rod-shaped section of the first fixing element 2, which is shown in FIG. 17. In particular, the connecting component 7 can now be guided through the interstitial tube 8, but this is not shown in the drawings for the clarity.

The connecting component 7 is then pivoted about the rod-shaped section of the first fixing element 2 until it reaches a rod-shaped section of the second fixing element 4, which is shown in FIG. 18. When the pivoting movement continues, the rod-shaped section of the second fixing element 4 slides along the guide surface 33, as a result of which the elastic locking hook of the second connecting element 27 is temporarily bent until the rod-shaped section reaches the indentation 31 and engages, which is shown in FIG. 19.

Figure 20:
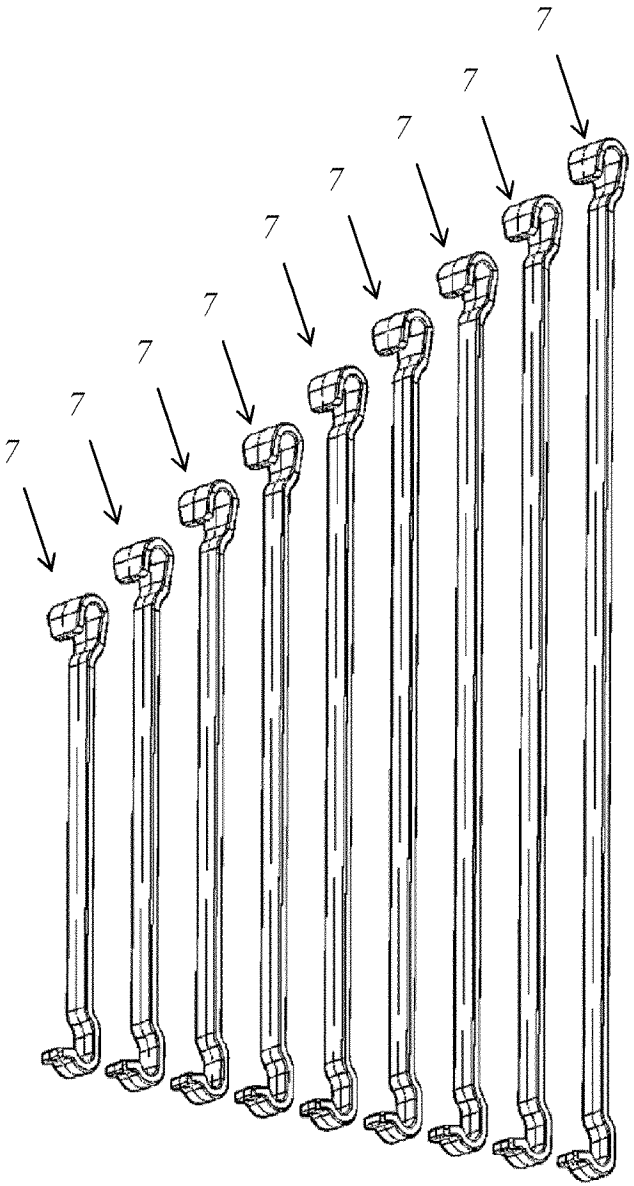
FIG. 20 shows variety of tool-free attachable connection components.

FIG. 20 shows an assortment of connecting components 7 which can be attached without tools and which have different lengths. This range can be used in particular in connection with the use of displacement bodies 6 of different total heights, for example for concrete ceilings of different heights. The assortment is preferably tailored to the fact that many different overall heights are realized by combining first displacement body parts 13 and second displacement body parts 14 which have different heights.

Figure 21:
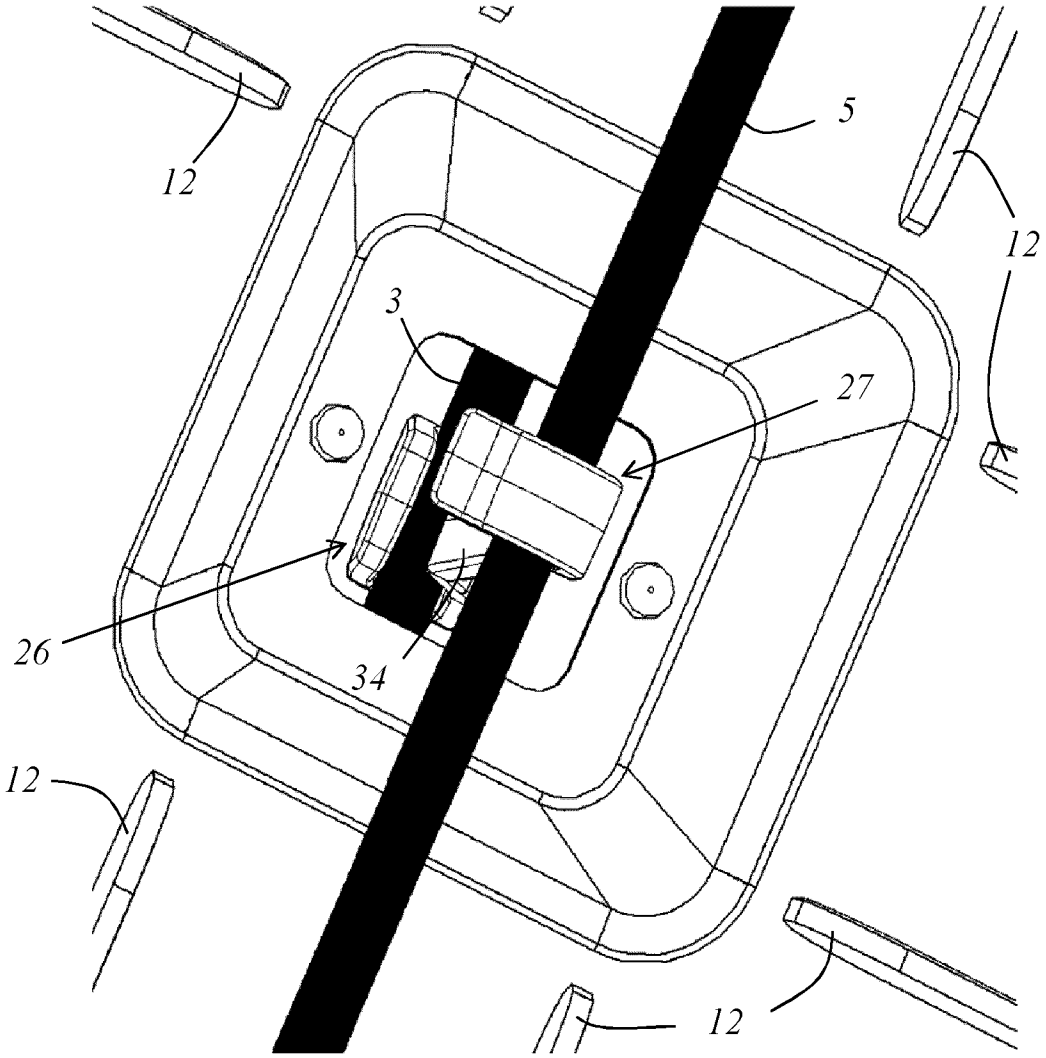
FIG. 21 is a detailed representation of a third embodiment of a concrete shaping insert according to the invention.

FIG. 21 shows a detailed illustration of a third exemplary embodiment of a concrete shaping insert 1 according to the invention, in which a connecting component 7 was used, which is shown in FIG. 16. The detailed representation allows a view through the interstitial tube 8. It can be seen in particular that the first fixing element 2 is latched to the first connecting element 26, while the second fixing element 47 is latched to the second connecting element 27 of the connecting component 7.

Figure 22:
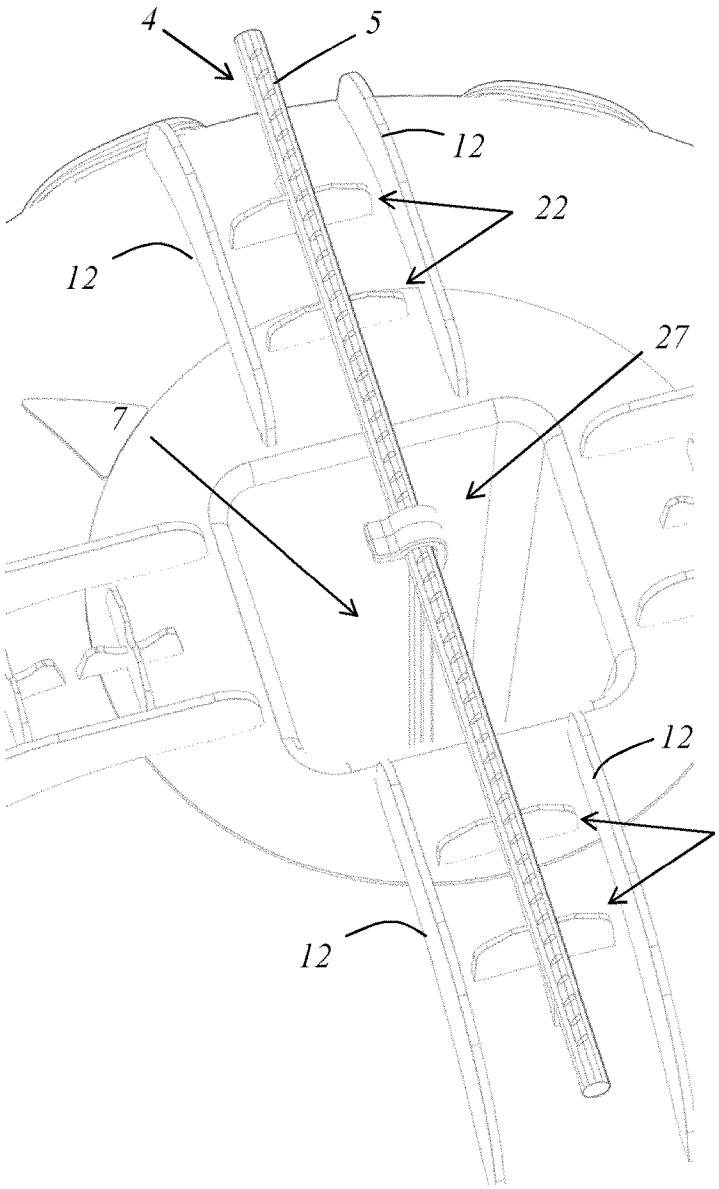
FIG. 22 is an upper detailed view for the third embodiment of a concrete shaping insert 1 according to the invention.
Figure 23:
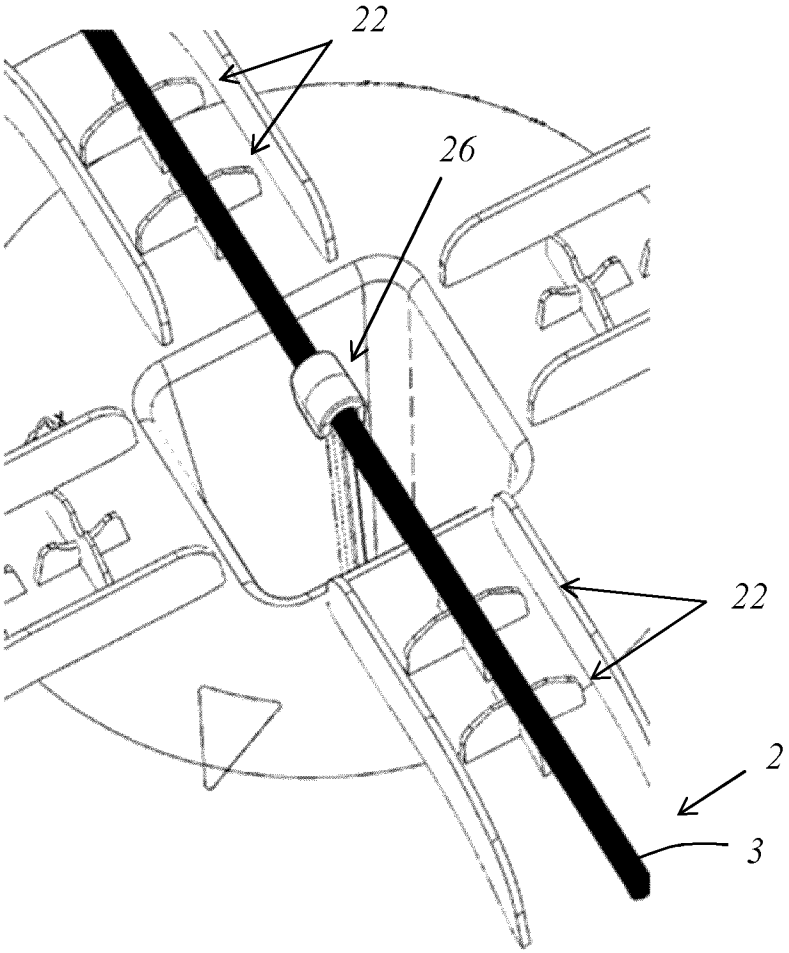
FIG. 23 is a bottom detailed view of the third embodiment of a concrete shaping insert 1 according to the invention.

FIG. 22 shows a detailed view of the third embodiment of a concrete shaping insert 1 according to the invention from above, while FIG. 23 shows a detailed view of the third embodiment of a concrete shaping insert 1 according to the invention from below.

Figure 24:
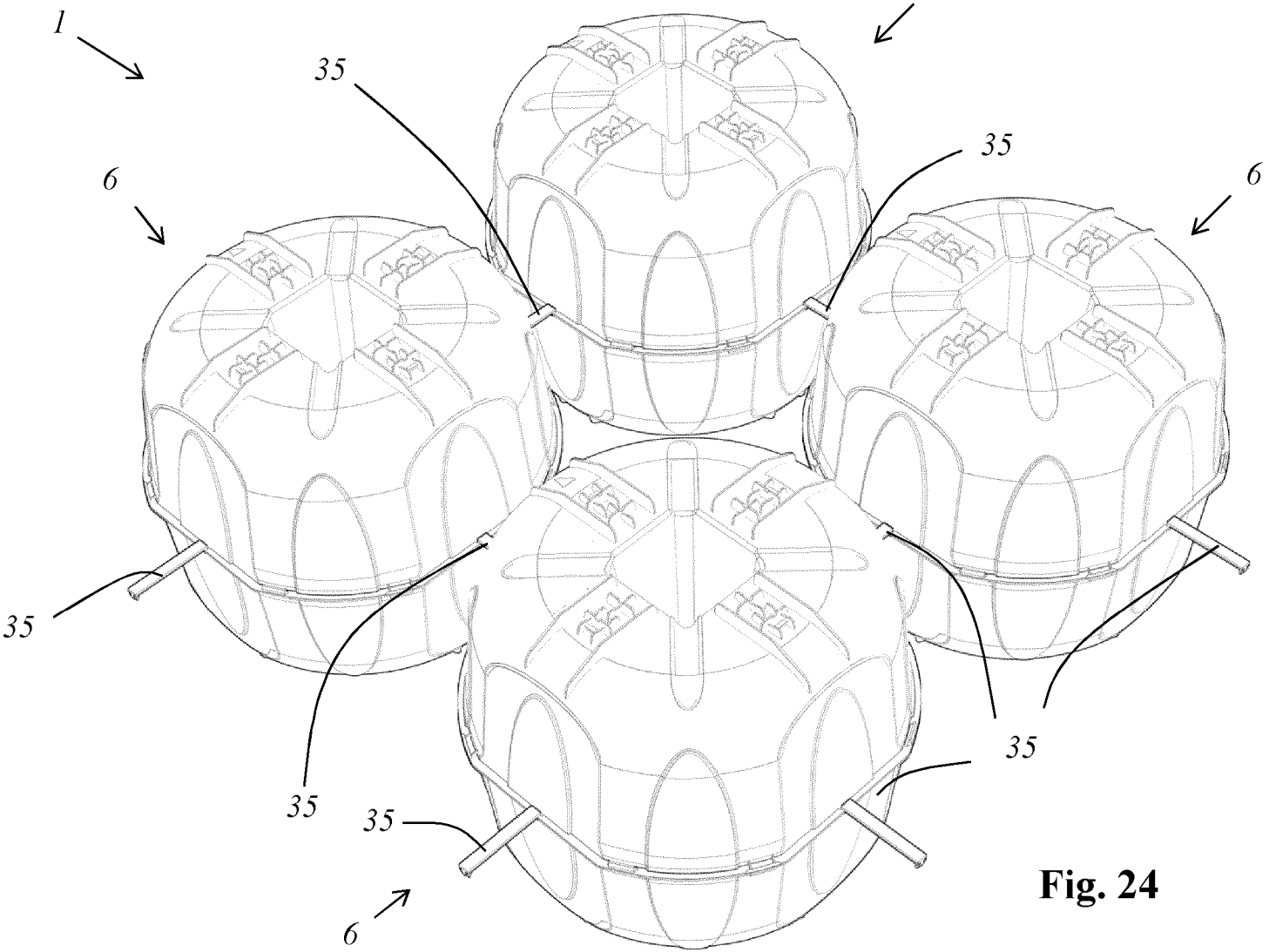
FIG. 24 shows detailed view of a fourth exemplary embodiment of a concrete shaping insert 1 according to the invention.
Figure 28:
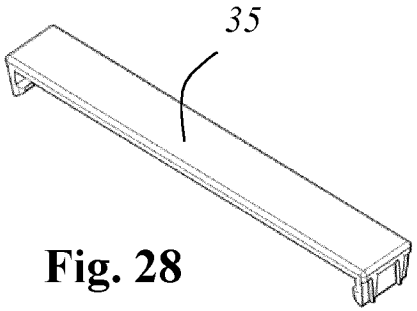
FIG. 28 shows another embodiment of a displacement body connector.

FIG. 24 shows a detailed view of a fourth exemplary embodiment of a concrete shaping insert 1 according to the invention, the first fixing element 2 and the second fixing element 4 and the connecting element 7 not being shown for clarity. In this exemplary embodiment, the displacement bodies 6 are connected to one another with a displacement body connector 35 at the equatorial height of the displacement bodies 6. The additional connecting component 35 also ensures in particular that the desired spacings between the displacement bodies 6 are maintained. A detailed view of a possible embodiment of the displacement body connector 35 is shown in FIG. 28.

Figure 25:
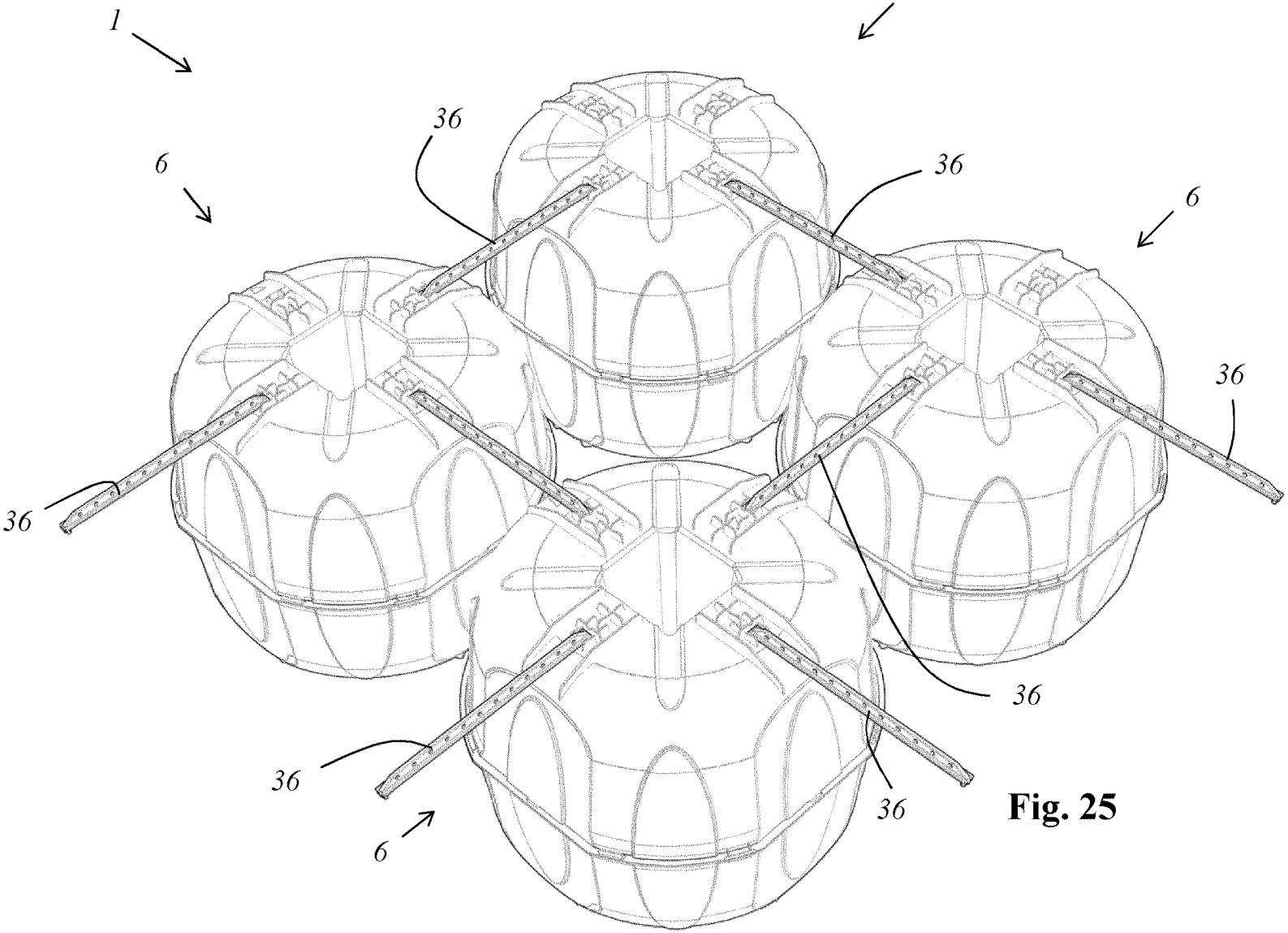
FIG. 25 shows detailed view of a fifth exemplary embodiment of a concrete shaping insert 1 according to the invention.
Figure 27:
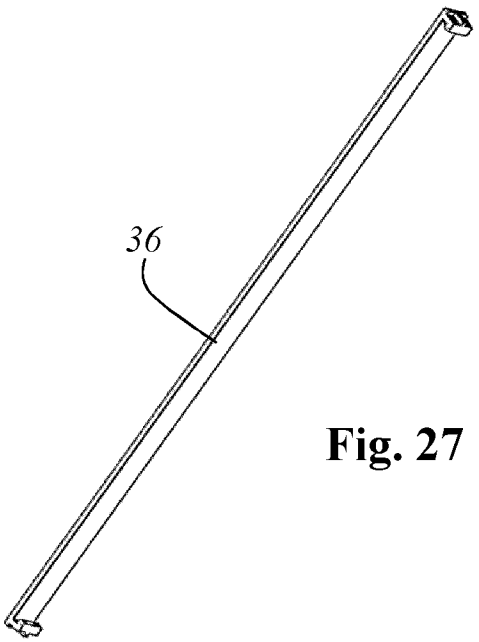
FIG. 27 shows an embodiment of a displacement body connector.

FIG. 25 shows a detailed view of a fifth exemplary embodiment of a concrete shaping insert 1 according to the invention, the first fixing element 2 and the second fixing element 4 and the connecting element 7 not being shown for clarity. In this exemplary embodiment, the displacement bodies 6 are connected to one another at the top with a displacement body connector 36. The displacement body connector 36 is hooked into a bearing element 22. The displacement body connector 36 in particular also ensures that the desired distances between the displacement bodies 6 are maintained. A detailed view of a possible embodiment of the displacement body connector 36 is shown in FIG. 29.

Figure 26:
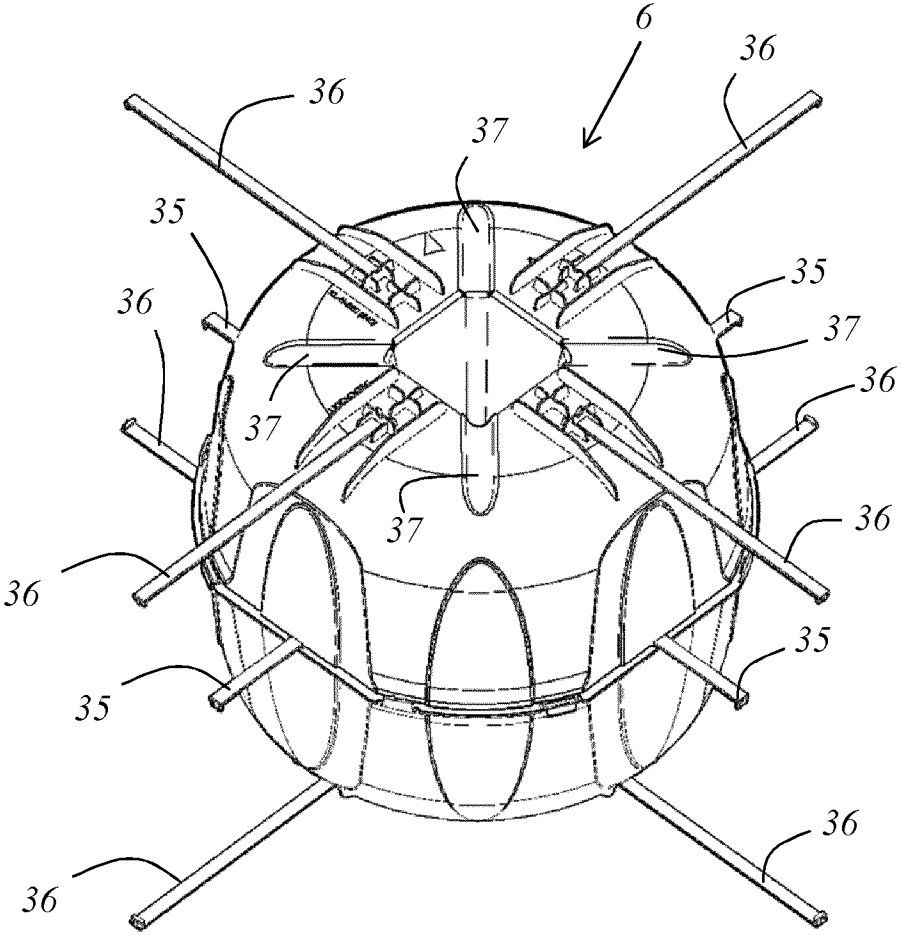
FIG. 26 shows detailed view of a sixth exemplary embodiment of a concrete shaping insert 1 according to the invention.

FIG. 26 shows a detailed view of a sixth embodiment of a concrete shaping insert 1 according to the invention, the first fixing element 2 and the second fixing element 4 and the connecting element 7 not being shown for clarity.

In this exemplary embodiment, the displacement bodies 6 are connected to a displacement body connector 35 at the equatorial height of the displacement body 6 and are also connected to one another at the top with a displacement body connector 36.

Figure 29:
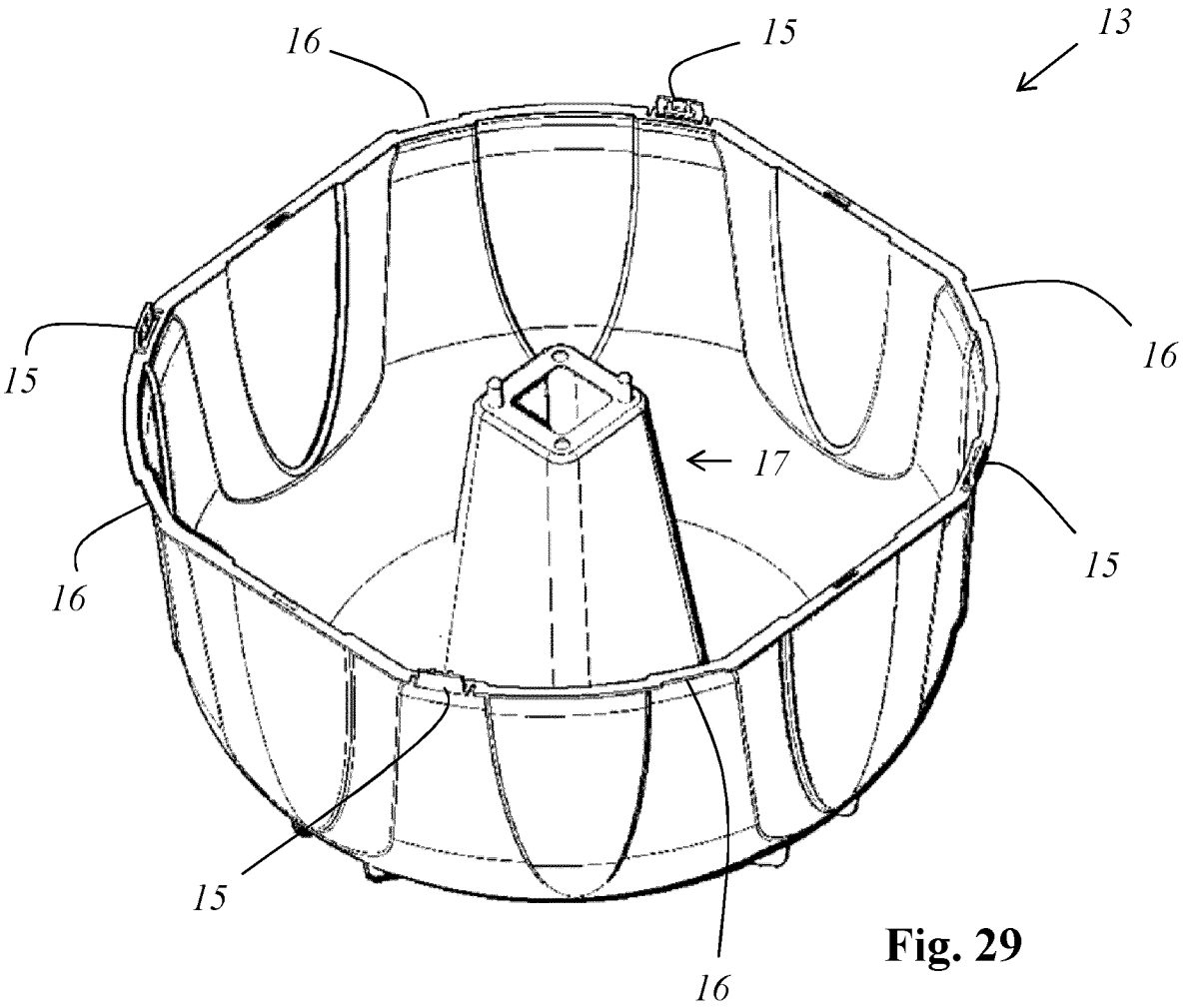
FIG. 29 shows a first displacement body part in an alternative design for a concrete shaping insert according to the invention.
Figure 30:
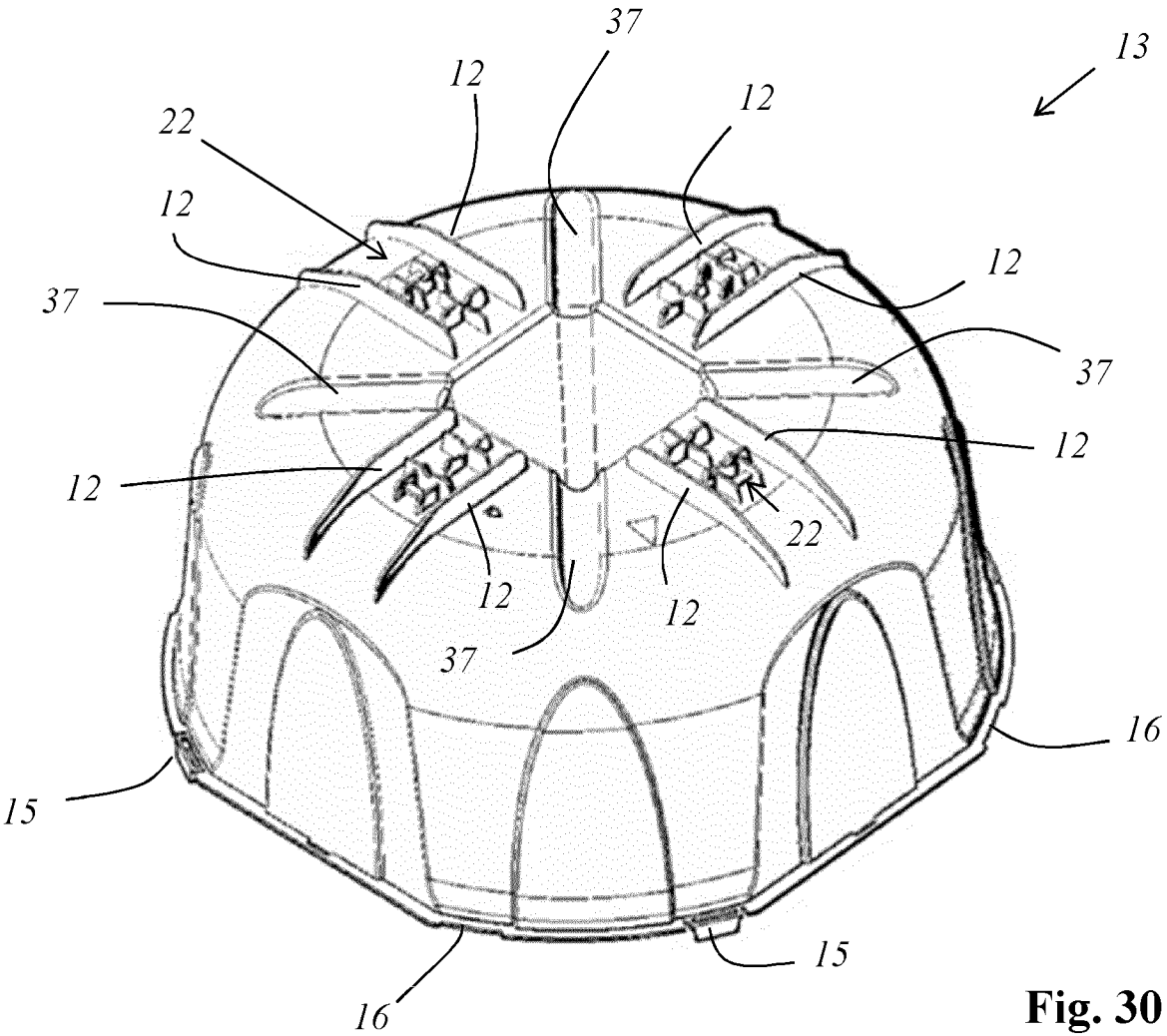
FIG. 30 shows a second displacement body part in an alternative design for a concrete shaping insert 1 according to the invention.

FIGS. 29 and 30 show a first displacement body part 13 and a second displacement body part 14 in an alternative design for a concrete shaping insert 1 according to the invention, in particular for a concrete shaping insert 1 as shown in FIGS. 24, 25 and 26. The displacement body parts 13, 14 are formed identically and have a plurality of channels 37 into which lines (not shown), in particular electrical lines, can be placed. In particular, it may be advantageous to install the second fixing element 4 after the lines have been laid, so that the lines are additionally secured in their position by the second fixing element 4. Alternatively, it is also possible, for example, to pull the lines through under the second fixing element 4 or to lay them above the second fixing element 4.

The displacement body 6 produced from the first displacement body part 13 and the second displacement body part 14 has flattened side surfaces and is particularly high in relation to its diameter. The flattened side surfaces make it possible to fill the space between adjacent displacement bodies 6 with a largely uniformly thick layer of concrete. These displacement bodies 6 are particularly intended to be used with particularly thick concrete ceilings. In this embodiment, too, it is possible (according to an independent inventive concept) to combine first displacement body parts 13 and second displacement body parts 14 of different heights with one another or, alternatively, to use the same displacement body parts 13, 14.

Figure 31:
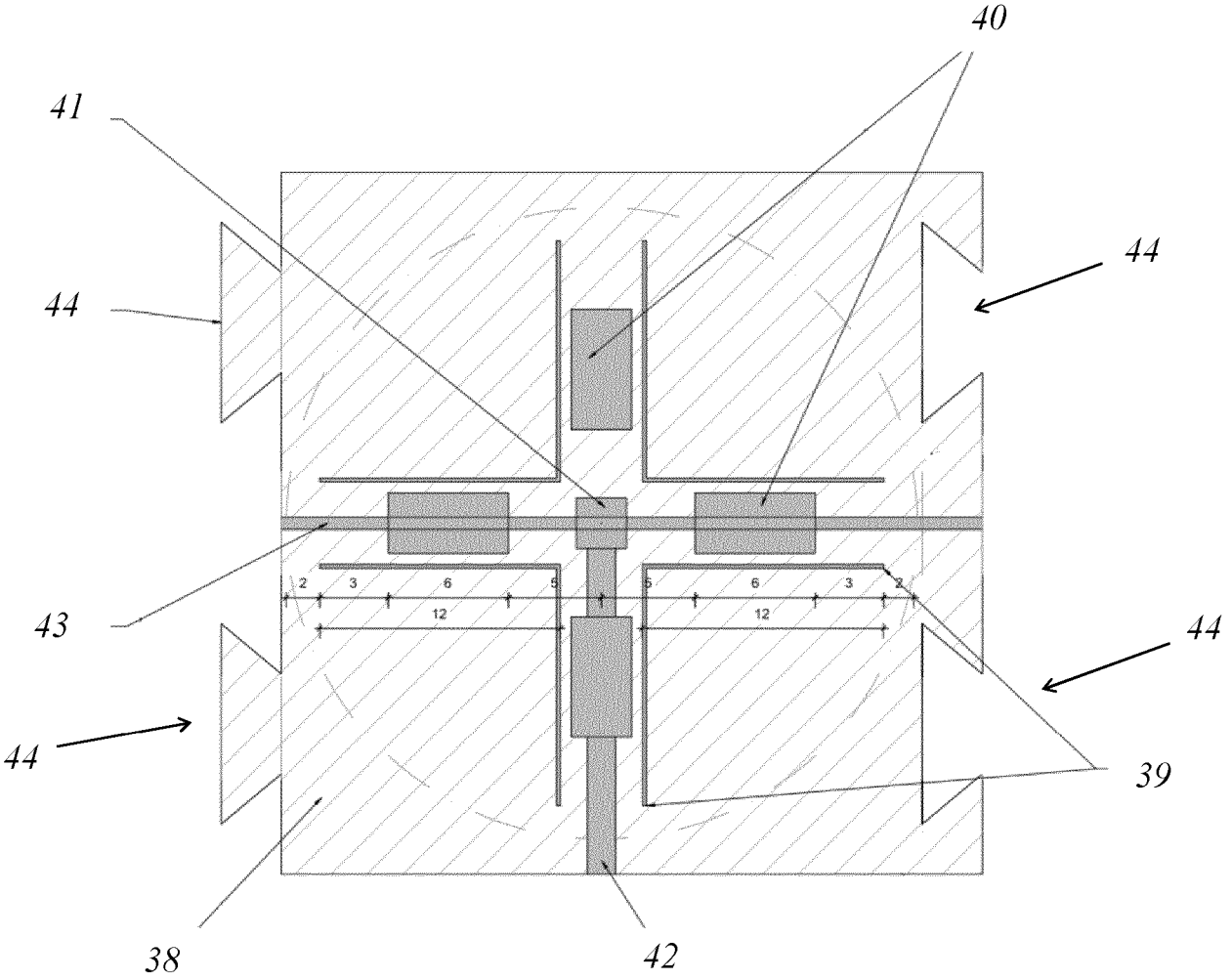
FIG. 31 an embodiment of a positioning aid.

FIG. 31 shows an embodiment of a positioning aid 38 which is plate-shaped. The positioning aid 38 can be used when assembling a concrete shaping insert according to the invention.

The positioning aid 38 is formed to hold exactly one displacement body 6 upright for an assembly process. The positioning aid 38 has first recesses 39 which are specially formed and arranged to receive the protruding members 12 of a displacement body 6. The positioning aid 38 has second recesses 40 which are specially formed and arranged to receive the bearing elements 22 of a displacement body 6. The positioning aid 38 has a third recess 41 which is specially formed and arranged to receive the first connecting element 26 of the connecting component 7. The positioning aid 38 has a fourth recess 42 which is specially formed to receive the web 34 of the connecting component 7. The positioning aid 38 has a fifth recess 43 which is specially formed and arranged to receive the first fixing element 2.

Figure 32:
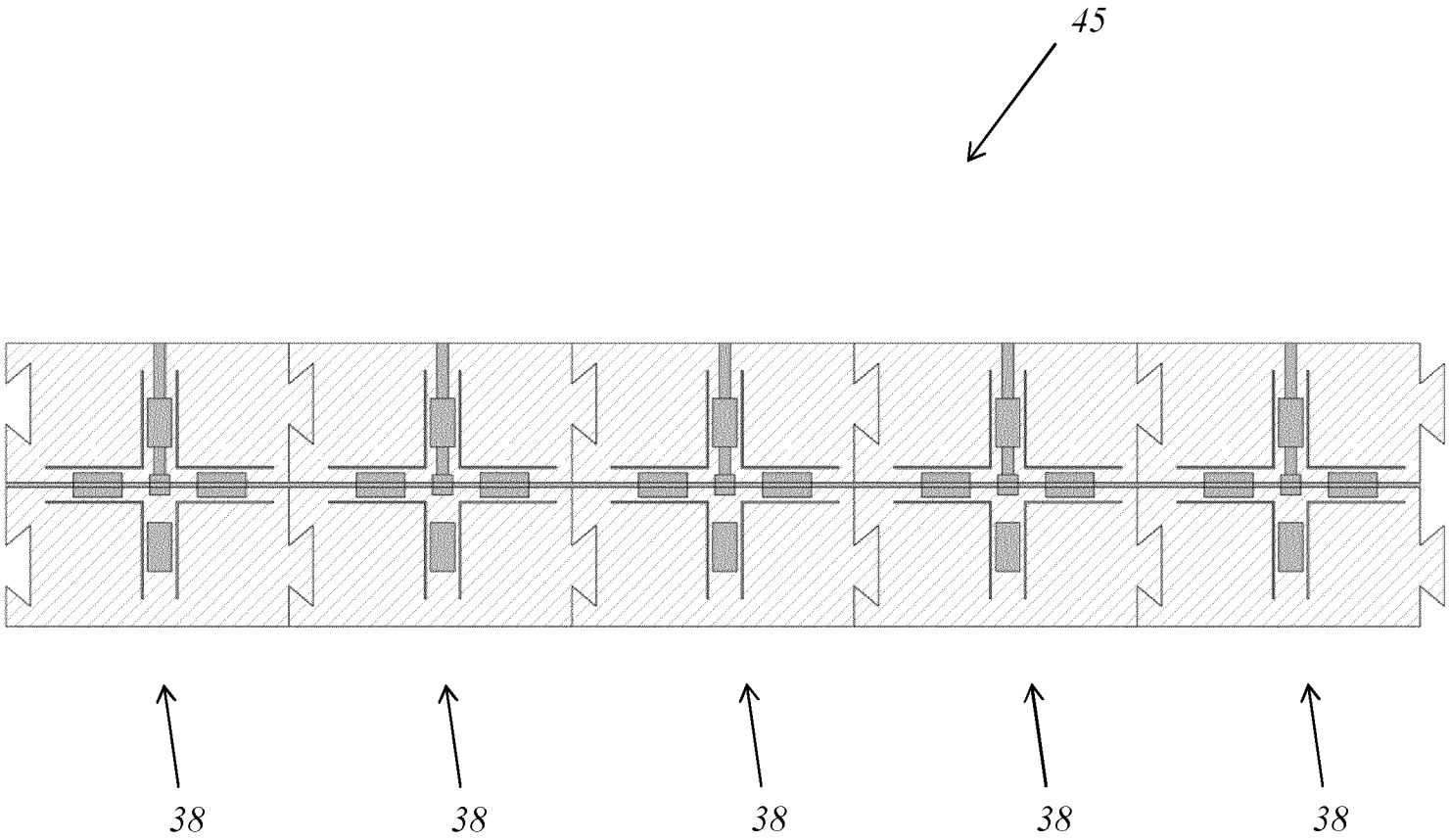
FIG. 32 shows an embodiment of a positioning aids system.

The positioning aid 38 has form-fit sections 44 which make it possible to connect several similar positioning aids 38 to one another to form a positioning aid system 45, which is shown in FIG. 32. The form-fit connections are formed in a similar way to puzzle pieces.

The assembly process of the concrete shaping insert 1 proceeds in a manner that several of the positioning aids 38 are first connected to one another in the required number and laid out on the floor. Then the first fixing element 2 and the required connecting components 7 are inserted into the recesses 421, 42, 43 of the positioning aids 38 provided for this purpose. In a next step, the displacement bodies 6 are positioned, the connecting component 7 being guided through the tube 8 and the members 12 and the bearing elements 22 of the respective displacement body 6 being inserted (preferably in a clamping manner) into the corresponding recesses 39, 40 of the respective positioning aid 38 so that the displacement body 6 is held upright by the positioning aid 38 as a result. The connecting components 7 are then coupled to the second fixing element 4.

The finished concrete shaping insert 1 is then released from the positioning aids 3 and brought to the place provided for a concreting process. The positioning aids 38 can then be used again for the assembly of the next concrete shaping insert 1. Finally, the positioning aids 38 can be released from one another again. The positioning aids 38 can advantageously be stacked on top of one another for transport.

Figure 33:
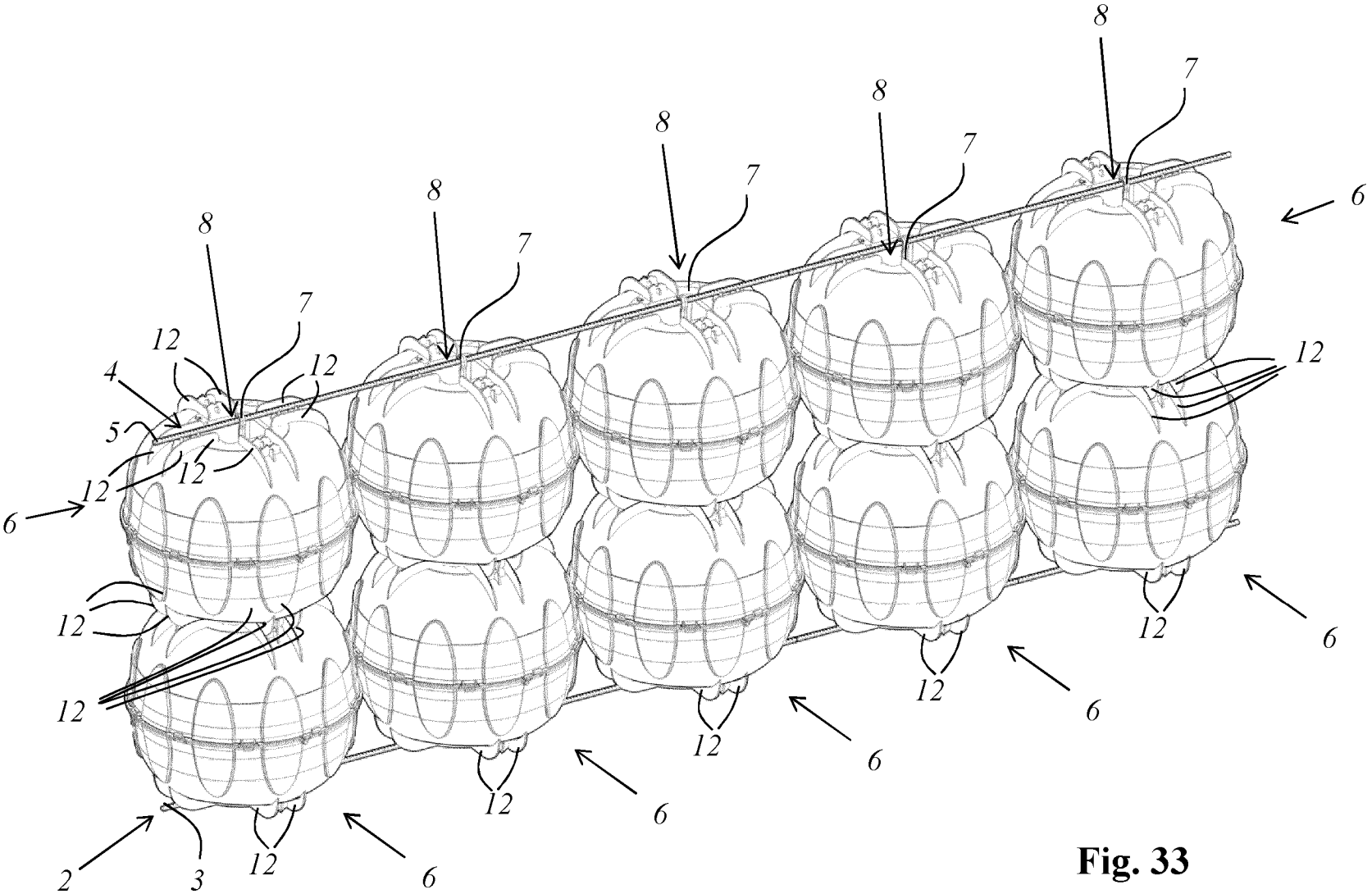
FIG. 33 is a detailed view of a seventh embodiment of a concrete shaping according to the invention.

FIG. 33 shows a seventh exemplary embodiment of a concrete shaping insert 1 according to the invention, which is formed to be arranged in a formwork before a concreting process. The concrete shaping insert 1 has a first fixing element 2, which is formed as a first reinforcing bar 3. The concrete shaping insert 1 also has a second fixing element 4, which is formed as a second reinforcing bar 5. The first reinforcing bar 3 and the second reinforcing bar 5 are arranged parallel to one another and lying vertically one above the other.

In addition, the concrete shaping system 1 has several identical displacement bodies 6, which are arranged in a row in pairs one above the other between the first fixing element 2 and the second fixing element 4. It would also be possible to arrange different displacement bodies 6, in particular different heights, one above the other.

The first fixing element 2 and the second fixing element 5 are connected to one another by means of a plurality of connecting components 7 that can be attached without tools. Each of the displacement bodies 6 has an interstitial tube 8. The interstitial tubes 8 of the displacement bodies 6 arranged one above the other are aligned with one another. A connecting component 7, which connects the first fixing element and the second fixing element to one another, through the aligned interstitial tubes 8 of the displacement bodies arranged one above the other.

The downwardly directed members 12 of the upper displacement body 6 and the upwardly directed members 12 of the lower displacement body 6 function in this embodiment as coupling means which interlock. The coupling means advantageously prevent the displacement bodies 6 from moving relative to one another, in particular during a concreting process.

LIST OF REFERENCE NUMBERS

1 concrete shaping insert
2 first fixing element
3 first rebar
4 second fixing element
5 second reinforcing bar
6 displacement bodies
7 connecting component
8 interstitial tubes
9 first reinforcement arrangement
10 second reinforcement arrangement
11 spacers
12 members
13 first displacement body part
14 second displacement body part
15 locking device
16 Lock projection
17 first interstitial tube section
18 second interstitial tube section
19 contact surfaces
20 cones
21 interstitial opining
22 bearing elements
23 trough
24 interstitial openings
25 collar
26 first connecting element
27 second connecting element
28 elastic locking hook
29 Recording
30 insertion gap
31 displacement
32 guide element
33 guide surface
34 bridge
35 displacement body connector
36 displacement body connector
37 gutter
38 Positioning aid
39 first recess
40 second recess
41 third recess
42 fourth recess
43 fifth recess
44 form-fit section
45 positioning aid system

The invention claimed is:

1. A concrete shaping insert to be arranged in a formwork mold before a concreting process, the concrete shaping insert comprising:

a first fixing element and a second fixing element, a plurality of displacement bodies arranged between the first fixing element and the second fixing element, wherein each displacement body of the plurality of displacement bodies includes a first displacement body part and a second displacement body part connected to the first displacement body part such that the displacement body is a hollow body having an interstitial tube therethough, and a plurality of connecting components formed separately from the plurality of displacement bodies, each connecting component of the plurality of connecting components including an elongated web, a first connecting element at a first end of the elongated web, and a second connecting element at a second end of the elongated web opposite the first end of the elongated web, wherein the first connecting element comprises an elastically deformable first locking hook having a receptacle and an insertion gap through which a section of the first fixing element is insertable for receipt in the receptacle of the first locking hook, wherein a passage width of the insertion gap of the first locking hook is smaller than an inner diameter of the receptacle of the first locking hook, wherein the second connecting element comprises an elastically deformable second locking hook having an indentation and a guide surface for guiding a section of the second fixing element into engagement with the indentation of the second locking hook, wherein the indentation of the second locking hook defines an insertion gap adjacent the guide surface through which a section of the second fixing element is insertable for receipt in the indentation of the second locking hook, wherein a passage width of the insertion gap of the second locking hook is greater than the passage width of the insertion gap of the first locking hook, wherein each connecting component of the plurality of connecting components is arranged to extend through the interstitial tube of a respective displacement body of the plurality of displacement bodies and is pivotable relative to the respective displacement body.

2. The concrete shaping insert according to claim 1, characterized in that the connecting component is configured to be fixed to the first fixing element without tools by means of the first connecting element or is configured to be fixed to the second fixing element without tools by means of the second connecting element.

3. The concrete shaping insert according to claim 1, characterized in that the first connecting element engages around a rod-shaped section of the first fixing element.

4. The concrete shaping insert according to claim 1, characterized in that the connecting component is formed in a manner that it is configured to be fastened initially to the first fixing element by means of the first connecting element, then it is configured to be fastened by performing a pivoting movement to be connected to the second fixing element.

5. The concrete shaping insert according to claim 1, characterized in that the connecting component is formed as an injection-molded part, plastic injection-molded part, a bent part, a bent sheet metal part or a bent wire part.

6. The concrete shaping insert according to claim 1, characterized in that the connecting component is made of one piece.

7. The concrete shaping insert according to claim 1, characterized in that the interstitial tube has a shape deviating from the circular shape in a cross-sectional plane perpendicular to its longitudinal direction.

8. The concrete shaping insert according to claim 1, characterized in that the first displacement body part has a first interstitial tube part and the second displacement body part has a second interstitial tube part, the first interstitial tube part and the second interstitial tube part together forming the interstitial tube, further characterized in that the first interstitial tube part has a first contact surface at an end of the first interstitial tube part, the second interstitial tube part has a second contact surface at an end of the second interstitial tube part, the first contact surface and the second contact surface in contact with one another, and wherein each of the first interstitial tube part and the second interstitial tube part is tapered such that a portion of the first interstitial tube part is receivable by the second interstitial tube part when the second displacement body part is stacked within the first displacement body part.

9. The concrete shaping insert according to claim 1, characterized in that the first displacement body part has a first connection device and that the second displacement body part has a second connection device, the first connection device and the second connection device working together and the first connecting device and the second connecting device are formed identically.

10. The concrete shaping insert according to claim 9, characterized in that the first displacement body part and the second displacement body part are each cover-shaped and configured to be connected or connected to one another by performing a connecting movement perpendicular to the plane of the cover opening by means of the connecting devices and further characterized in that the first connecting device and the second connecting device optionally each have at least one locking element.

11. The concrete shaping insert according to claim 1, characterized in that the first displacement body part and the second displacement body part have a different height.

12. The concrete shaping insert according to claim 1, characterized in that each of the plurality of displacement bodies has a plurality of protruding members on its external surface, or that each of the plurality of displacement bodies has a plurality of protruding members on its external surface, which, starting from the external surface, have a height in the domain of 10 mm to 25 mm.

13. The concrete shaping insert according to claim 1, characterized in that each of the plurality of displacement bodies has on its external surface at least one first bearing element with a receptacle for a portion of the first fixing element and/or at least has a second bearing element with a receptacle for a portion of the second fixing element.

14. The concrete shaping insert according to claim 1, characterized in that the plurality of connecting components exert a force directed towards a corresponding one of the plurality of displacement bodies on the first fixing element and the second fixing element.

15. The concrete shaping insert according to claim 1, characterized in that plurality of connecting components are components that are separate from a corresponding one of the plurality of displacement bodies.

16. The concrete shaping insert according to claim 1, characterized in that a. the first fixing element or the second fixing element has at least one rod or characterized in that b. the first fixing element or the second fixing element has a rod which is part of a reinforcement grid, or characterized in that c. the first fixing element or the second fixing element consists exclusively of a rod.

17. The concrete shaping insert according to claim 1, characterized in that the first fixing element and second fixing element are arranged parallel to one another and/or that the first fixing element and second fixing element are arranged together in a symmetry plane of the displacement body.

18. The concrete shaping insert according to claim 1, characterized in that a. the concrete shaping insert is formed to be arranged in a formwork mold in addition to reinforcement prior to concreting, or characterized in that b. the concrete shaping insert is formed to be arranged in a formwork mold between two reinforcement arrangements prior to concreting.

19. The concrete shaping insert according to claim 1, characterized in that adjacent displacement bodies of the plurality of displacement bodies are connected directly to one another with a displacement body connector.

20. A concrete component containing at least one of the concrete shaping insert according to claim 1.

21. A method for producing the concrete shaping insert according to claim 1, characterized in that the displacement body, which has the interstitial tube, is arranged between the first fixing element and the second fixing element and that the first fixing element and the second fixing element are connected by means of the connecting component which proceeds through the interstitial tube.

22. The method according to claim 21, characterized in that the displacement body is fixed between the first fixing element and the second fixing element by means of the connecting component.

23. The method according to claim 21, characterized in that the connecting component is first attached to the first fixing element, and the connecting component is then inserted through the interstitial tube of the displacement body and that the connecting component is then attached to the first fixing element.

24. The method according to any claim 21, characterized in that each displacement body is temporarily fixed on a positioning aid, which holds the displacement body in a desired position.

25. A method for producing a concrete component, characterized in that at least one of the concrete shaping insert of claim 1 is produced in a formwork mold or outside at least one concrete shaping insert, which is then arranged and fastened, in the formwork mold.

26. The method according to claim 25, characterized in that at least one reinforcement arrangement different from the first fixing element and/or the second fixing element is arranged in the formwork mold.

27. The method according to claim 25, characterized in that the formwork mold is filled with concrete in one or more steps.

* * * * *